US010766261B2

(12) United States Patent
Kikuchi

(10) Patent No.: US 10,766,261 B2
(45) Date of Patent: Sep. 8, 2020

(54) HEAD CLEANING DEVICE AND LIQUID DISCHARGE APPARATUS

(71) Applicant: Atsushi Kikuchi, Kanagawa (JP)

(72) Inventor: Atsushi Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/356,561

(22) Filed: Mar. 18, 2019

(65) Prior Publication Data

US 2019/0283431 A1 Sep. 19, 2019

(30) Foreign Application Priority Data

Mar. 19, 2018 (JP) ..... 2018-051558
Feb. 4, 2019 (JP) ..... 2019-018202

(51) Int. Cl.
*B41J 2/165* (2006.01)

(52) U.S. Cl.
CPC ..... *B41J 2/16535* (2013.01)

(58) Field of Classification Search
CPC ..... B41J 2/16535; B41J 2002/1655; B41J 2/16538; B41J 2/16544; B41J 2/16547; B41J 29/38; B41J 2/165
See application file for complete search history.

(56) References Cited

U.S. PATENT DOCUMENTS

2012/0038707 A1* 2/2012 Maida ..... B41J 2/16544 347/33
2017/0157935 A1* 6/2017 Ohnishi ..... B41J 2/16535
2017/0232741 A1 8/2017 Kikuchi et al.

FOREIGN PATENT DOCUMENTS

JP 2010-253823 11/2010
JP 2011-073145 4/2011
JP 2011-240532 12/2011

* cited by examiner

*Primary Examiner* — Jannelle M Lebron
(74) *Attorney, Agent, or Firm* — Duft & Bornsen, PC

(57) ABSTRACT

A head cleaning device includes a first wiping member, a first drive mechanism, a second wiping member, a second drive mechanism, a common drive source, and control circuitry. The first wiping member wipes a nozzle face of each of a plurality of liquid discharge heads. The first drive mechanism moves the first wiping member to a first wiping position at which the first wiping member wipes the nozzle face and a first retraction position spaced apart from the nozzle face. The second wiping member wipes the nozzle face. The second drive mechanism moves the second wiping member to a second wiping position at which the second wiping member wipes the nozzle face and a second retraction position spaced apart from the nozzle face. The common drive source drives the first drive mechanism and the second drive mechanism. The control circuitry controls the common drive source.

14 Claims, 25 Drawing Sheets

HEAD CLEANING DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2018-051558, filed on Mar. 19, 2018, and 2019-018202, filed on Feb. 4, 2019, in the Japan Patent Office, the entire disclosure of each of which is hereby incorporated by reference herein.

BACKGROUND

Technical Field

Aspects of the present disclosure relate to a head cleaning device and a liquid discharge apparatus.

Related Art

Conventionally, there has been known an image forming apparatus including liquid-droplet discharge nozzles of a plurality of liquid-droplet discharge heads that are arranged, the image forming apparatus being to discharge liquid droplets from the arranged liquid-droplet discharge nozzles to form an image on a printing medium. For example, for an image forming apparatus termed an inkjet printer including this type of liquid-droplet discharge head, adhesion of ink to the nozzle face of an inkjet head stains the nozzle face for discharge of ink. Thus, this type of image forming apparatus is equipped with a cleaning unit that cleans ink. For example, a type of cleaning unit wipes the ink stain adhering to the nozzle face of the inkjet head, with a web and a wiper blade.

Such a cleaning unit that performs wiping with the web and the wiper blade, is provided with a drive source and a drive assembly for each of the web and the wiper blade, to move the web and the wiper blade each to a wiping position or a retraction position. However, provision of individual drive sources and drive assemblies increases an apparatus in size, resulting in increase in costs, rightfully.

SUMMARY

In an aspect of the present disclosure, there is provided a head cleaning device that includes a first wiping member, a first drive mechanism, a second wiping member, a second drive mechanism, a common drive source, and control circuitry. The first wiping member wipes a nozzle face of each of a plurality of liquid discharge heads. The first drive mechanism moves the first wiping member to a first wiping position at which the first wiping member wipes the nozzle face and a first retraction position spaced apart from the nozzle face. The second wiping member wipes the nozzle face. The second drive mechanism moves the second wiping member to a second wiping position at which the second wiping member wipes the nozzle face and a second retraction position spaced apart from the nozzle face. The common drive source drives the first drive mechanism and the second drive mechanism. The control circuitry controls the common drive source.

In another aspect of the present disclosure, there is provided a liquid discharge apparatus that includes the head cleaning device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
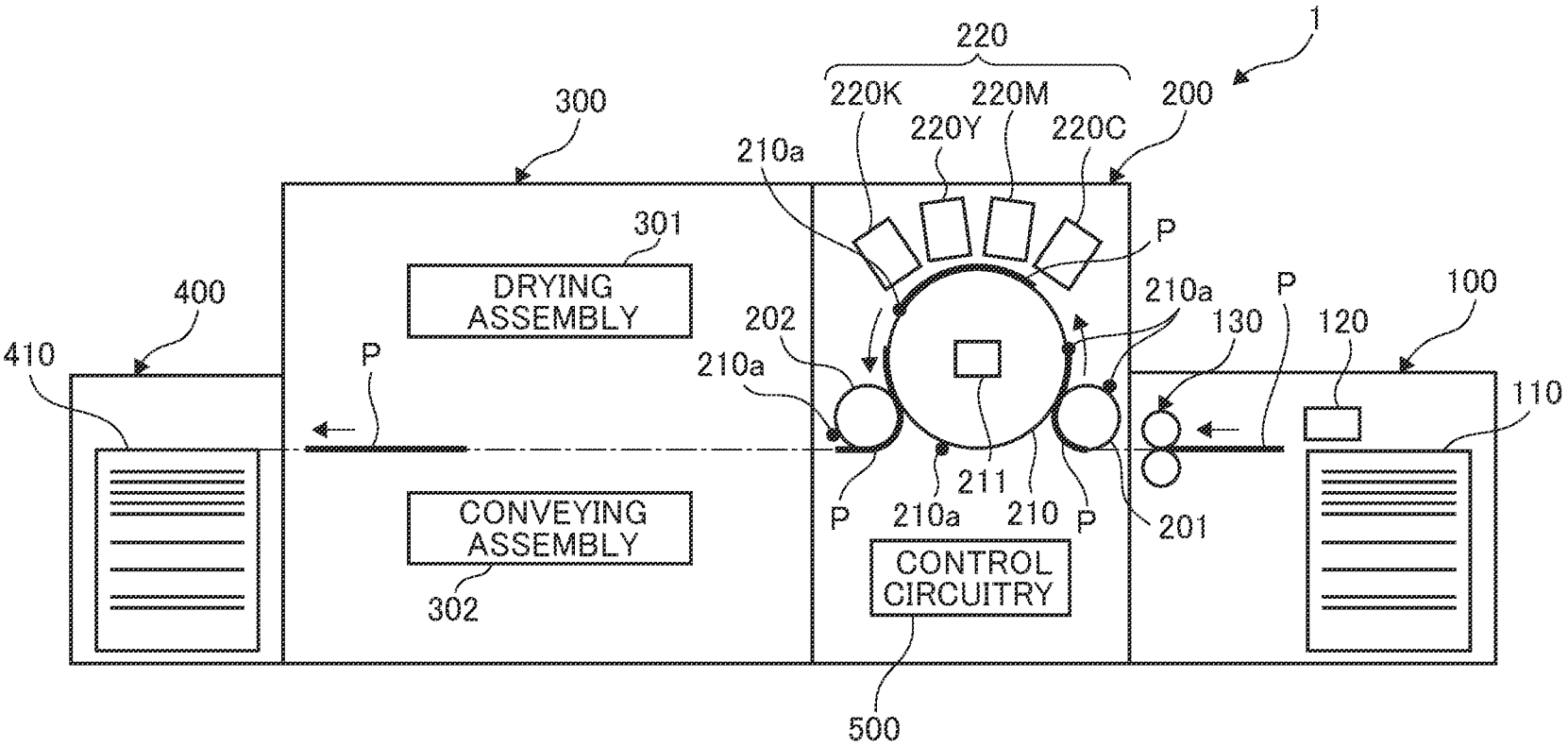
FIG. 1 is a schematic view of the configuration of an inkjet recording apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

According to a gist of the present disclosure, there is provided a head cleaning device that performs, for example, wiping with a web and a wiper blade to clean a stain adhering to the nozzle face of an inkjet head that discharges liquid, in which the movement operation of a web presser between a wiping position and a retraction position that are invariant regardless of the amount of reeling of the web, and the movement operation of the wiper blade between a wiping position and a retraction position, are performed with a common (shared) drive source. Embodiments of the present disclosure will be described below with reference to the drawings.

A "liquid discharge apparatus" according to the present embodiment includes a head that discharges liquid, and drives the head to discharge the liquid. Examples of the "liquid discharge apparatus" include an apparatus that discharges liquid in the air or in liquid as well as an apparatus capable of discharging liquid to an object to which discharging is to be performed. For example, an image forming apparatus, a three-dimensionally shaping apparatus, a treatment-liquid coating apparatus, and a jet granulation apparatus are applicable. According to the present embodiment, as one example of the "liquid discharge apparatus", an inkjet recording apparatus that is an image forming apparatus, is exemplified.

In the following descriptions, the same constituent elements or similar constituent elements are denoted with the same reference signs, and thus the descriptions of the constituent elements will be omitted appropriately.

First Embodiment

General Description

FIG. 1 is a schematic view of the configuration of an inkjet recording apparatus 1 according to a first embodiment of the present disclosure. As illustrated in FIG. 1, the inkjet recording apparatus 1 as an image forming system basically includes a sheet feeder 100, an image forming device 200, a dryer 300, and a sheet ejector 400. In the inkjet recording apparatus 1, the image forming device 200 discharges ink that is liquid for image forming, to a sheet P that is a recording material including a sheet material as a medium fed from the sheet feeder 100, to form an image. The dryer 300 dries the ink adhering onto the sheet P, and then the sheet ejector 400 ejects the sheet P.

Sheet Feeder

The sheet feeder 100 includes a sheet feeding tray 110 in which a plurality of sheets P is loaded, a feeding device 120 that separates the sheets one by one from the sheet feeding tray 110 to feed a sheet out, and a pair of registration rollers 130 that feeds the sheet into the image forming device 200. For the feeding device 120, any publicly known feeding device having a feeding function, can be used, such as a device employing rollers and rolling elements or a device utilizing air suction. A sheet P fed out from the sheet feeding tray 110 by the feeding device 120, is fed to the image forming device 200 by driving of the pair of registration rollers 130 at a predetermined timing after arrival of the front end of the sheet P at the pair of registration rollers 130. Note that, in the present embodiment, the configuration of the sheet feeder 100 is not particularly limited as long as the sheet feeder 100 has a function of feeding a sheet P out to the image forming device 200.

Image Forming Device

The image forming device 200 includes a receiving cylinder 201, a sheet conveying drum 210 (conveying member), an ink discharger 220, and a delivering cylinder 202. The receiving cylinder 201 receives the fed sheet P (recording medium). The sheet conveying drum 210 that is a cylindrical conveying member, conveys the sheet P conveyed by the receiving cylinder 201 while bearing the sheet P on the outer circumferential face of the sheet conveying drum 210. The ink discharger 220 discharges ink to the sheet P conveyed by the sheet conveying drum 210. The delivering cylinder 202 delivers the sheet P conveyed by the sheet conveying drum 210, to the dryer 300.

The sheet P conveyed from the sheet feeder 100 to the image forming device 200, is conveyed along with movement of the surface of the receiving cylinder 201, with the front end of the sheet P gripped by a sheet gripper **210*a* provided on the surface of the receiving cylinder 201. The sheet P conveyed by the receiving cylinder 201 is delivered to the sheet conveying drum 210 at a position opposed to the sheet conveying drum 210. Note that the sheet gripper 210*a*** has a publicly known structure.

A sheet gripper **210*a* is provided on the surface of the sheet conveying drum 210, and the front end of the sheet P is gripped by the sheet gripper 210*a*. The surface of the sheet conveying drum 210 has a plurality of distributed suction holes. A suction device 211 generates a suction flow to the inside of the sheet conveying drum 210, in each suction hole. Due to the suction flows, the sheet P is attracted to the surface of the sheet conveying drum 210. The sheet P delivered from the receiving cylinder 201 to the sheet conveying drum 210, is attracted to the surface of the sheet conveying drum 210 due to the suction flows with the front end of the sheet P gripped by the sheet gripper 210***a*. The sheet P is conveyed along with movement of the surface of the sheet conveying drum 210.

The ink discharger 220 that discharges inks in four colors of cyan (C), magenta (M), yellow (Y), and black (K) to form an image, includes individual line heads 220C, 220M, 220Y, and 220K for the ink colors. As long as the line heads 220C, 220M, 220Y, and 220K each discharge liquid, the configuration of each of the line heads 220C, 220M, 220Y, and 220K is not limited, and thus any configuration can be adopted. As necessary, provided can be a liquid discharge head that discharges special ink, such as white, gold, or silver in color, or provided can be a liquid discharge head that discharges liquid not to be included in an image, such as surface coating liquid.

The line heads 220C, 220M, 220Y, and 220K of the ink discharger 220 each include a plurality of liquid discharge heads 221 to be described later. The discharge operations of the line heads 220C, 220M, 220Y, and 220K are each controlled by a drive signal corresponding to image information. When the sheet P conveyed by the sheet conveying drum 210 passes through a region opposed to the ink discharger 220, the inks for the colors are discharged from the respective lower faces (nozzle faces) of the liquid discharge heads, to form an image corresponding to the image information. The liquid discharge heads 221 can each have a publicly known configuration. Here, the "liquid discharge head" means a functional component that discharges liquid.

Note that, in the present embodiment, the image forming device 200 is required at least to have a function of causing liquid to adhere onto a sheet P to form an image, and thus the configuration of discharging liquid or causing adhesion of liquid is not particularly limited.

Dryer

The dryer 300 includes a drying assembly 301 and a conveying assembly 302. The drying assembly 301 dries the ink adhering onto the sheet P through the image forming device 200. The conveying assembly 302 conveys the sheet P conveyed from the image forming device 200, to the sheet ejector 400 side. That is, after the conveying assembly 302 receives the sheet P conveyed from the image forming device 200, the conveying assembly 302 conveys the sheet P such that the sheet P passes through the drying assembly 301, so that the sheet P is delivered to the sheet ejector 400. When the sheet P passes through the drying assembly 301, the ink on the sheet P is subjected to drying processing. This arrangement allows the component of liquid, such as moisture, in the ink to evaporate, so that the ink is fastened on the sheet P and additionally the sheet P is inhibited from curling.

Sheet Ejector

The sheet ejector 400 includes a sheet ejection tray 410 in which a plurality of sheets P is to be loaded. The sheet P conveyed from the dryer 300 by the conveying assembly 302 is piled and retained on the sheet ejection tray 410, successively. Note that, in the present embodiment, the sheet ejector 400 is required at least to have a function of ejecting a sheet P, and thus the configuration of the sheet ejector 400 is not particularly limited.

Other Functional Units

Although the inkjet recording apparatus 1 according to the present embodiment includes the sheet feeder 100, the image forming device 200, the dryer 300, and the sheet ejector 400, other functional units may be appropriately added. For example, a preprocessor that performs preprocessing on image forming, can be added between the sheet feeder 100 and the image forming device 200, or a postprocessor that performs postprocessing on image forming, can be added between the dryer 300 and the sheet ejector 400.

For example, the preprocessor performs treatment-liquid coating processing of coating a sheet P with treatment liquid that reacts with the ink to inhibit bleed. However, the contents of the preprocessing are not particularly limited. For example, the postprocessor performs sheet-reverse conveying processing of reversing a sheet on which an image is formed by the image forming device 200 and refeeding the sheet to the image forming device 200 to form an image on the other face or processing of binding a plurality of sheets on which an image is formed. Here, the contents of the postprocessing are not particularly limited.

Note that, in the present embodiment, the "liquid discharge apparatus" is described exemplarily with the image forming device 200 of the inkjet recording apparatus 1. However, the "liquid discharge apparatus" is not limited to visualization of a meaningful image, such as a character or a figure, with discharged liquid with a liquid discharge head that discharges liquid to a face to be dried of a sheet material, and thus includes, for example, formation of a pattern having no meaning.

The sheet material is not limited in quality, and thus is required at least to include an object to which liquid can adhere temporarily, such as paper, thread, fiber, fabric cloth, leather, metal, plastic, glass, wood, or ceramics. For example, there may be provided an object to be used for a film product, a cloth product, such as clothing, a building material, such as wallpaper or flooring, or a leather product. In the present embodiment, the object to which liquid can adhere temporarily is referred to as the "medium".

The "liquid discharge apparatus" can include not only means involved in feeding, conveyance, and sheet ejection of an object to which liquid can adhere, but also a preprocessing device and a postprocessing device.

The "liquid" is not particularly limited, and thus is required at least to have viscosity or surface tension allowing a head to discharge the liquid. Preferably, the viscosity is not greater than 30 mPa·s under ordinary temperature and ordinary pressure or by heating or cooling.

More specifically, examples of the "liquid" include solution, suspension, and emulsion each including solvent, such as water or organic solvent, colorant, such as dye or pigment, functional material, such as a polymerizable compound, resin, or surfactant, biocompatible material, such as DNA, amino acid, protein, or calcium, or edible material, such as natural coloring matter. For example, these can be used for inkjet ink or surface treatment liquid.

The "liquid discharge apparatus" may be, but is not limited to, an apparatus in which a liquid discharge head and a sheet material move relatively. Specific examples include a serial type apparatus that moves a liquid discharge head and a line type apparatus that does not move a liquid discharge head.

The "liquid discharge head" is a functional component that discharges/jets liquid from discharge holes (nozzles). As an energy generation source for discharging liquid, a discharge energy generator can be used, such as a piezoelectric actuator (laminated piezoelectric element or thin-film piezoelectric element), a thermal actuator that employs an electrothermal conversion element, such as a heating resistor, or an electrostatic actuator including a diaphragm and opposed electrodes. However, the discharge energy generator to be used is not limited.

Note that, as to be described later, in the present embodiment, arrangement of a plurality of liquid discharge heads in a sheet-width direction (direction orthogonal to the conveyance direction of a sheet P) allows a long liquid discharge head (line head).

The "wiping" includes the meaning of cleaning, recovery, cleansing, maintenance, sweeping, and washing. Unless otherwise specified, these words are treated as a synonym.

Figure 2:
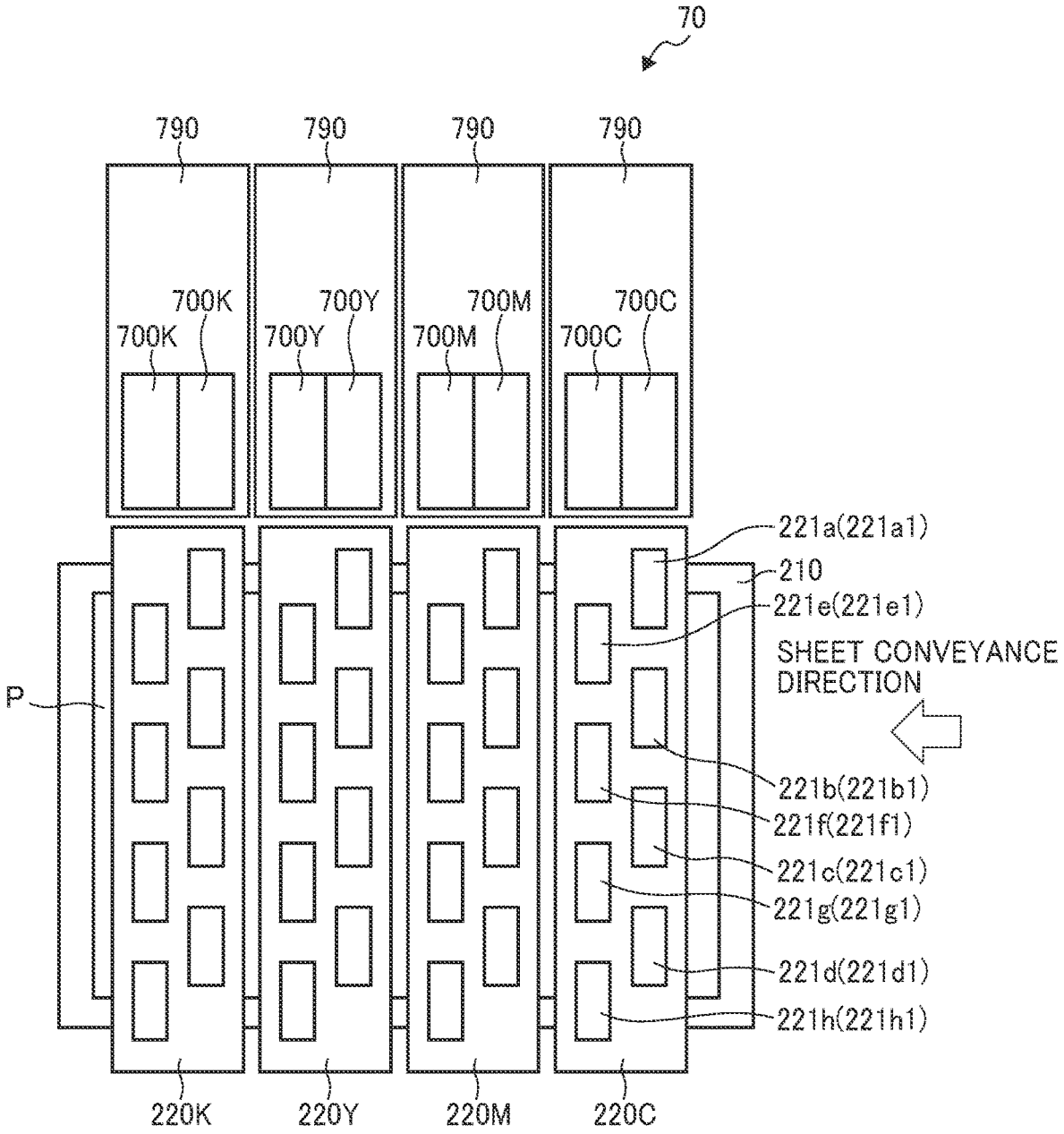
FIG. 2 is a main plan view of an image forming device before each rail member moves in a sheet-width direction in the first embodiment.
Figure 3:
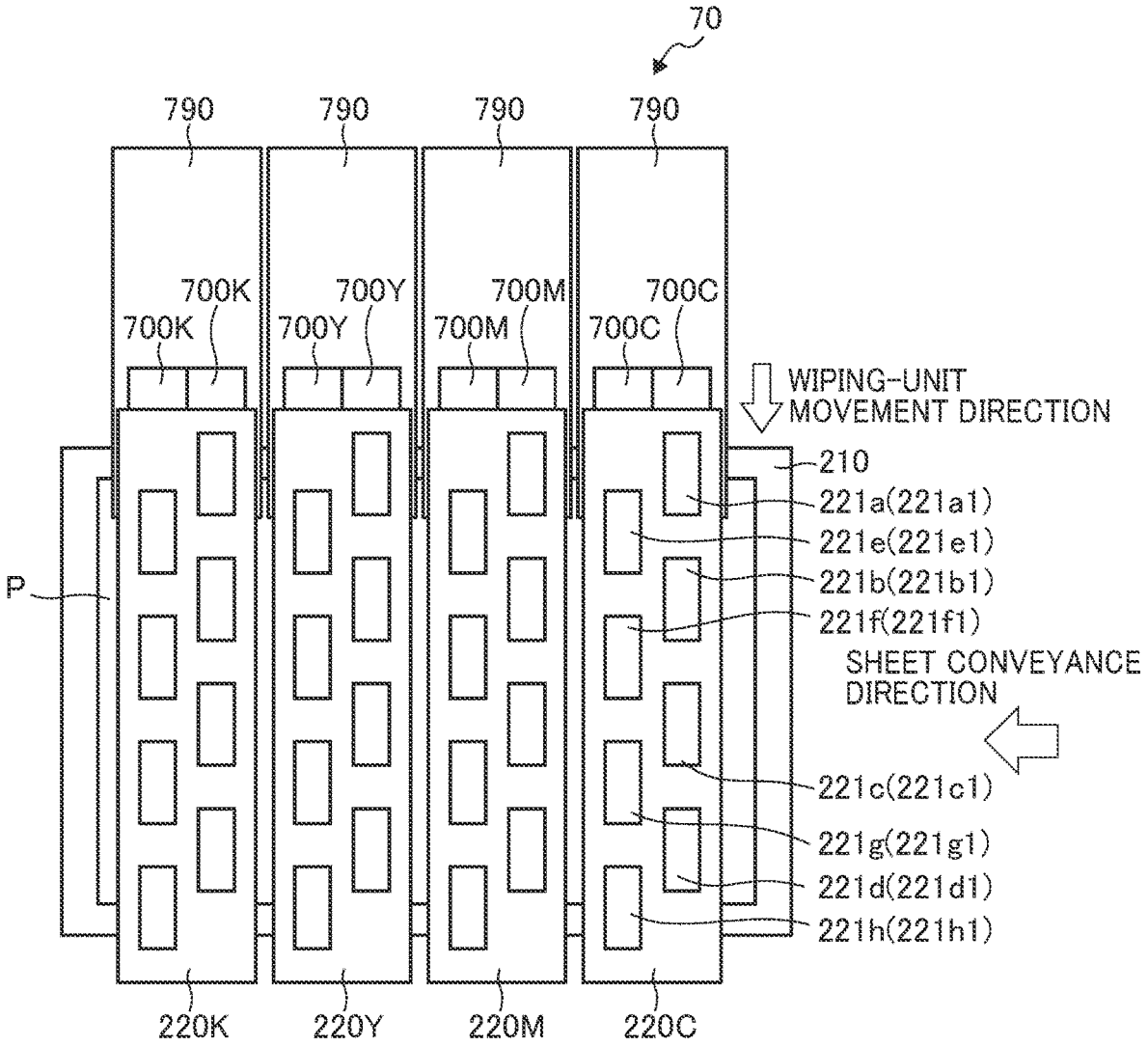
FIG. 3 is a main plan view of the image forming device after each rail member moves in the sheet-width direction in the first embodiment.

FIGS. 2 and 3 are intended for describing the configuration of a wiping-unit neighborhood. FIG. 2 is a main plan view of the image forming device 200 before rail members 790 move in the sheet-width direction. FIG. 3 is a main plan view of the image forming device 200 after the rail members 790 move in the sheet-width direction.

In FIG. 2, the line head 220C that discharges the ink for cyan includes first to eighth liquid discharge heads 221*a* to 221*h* along the sheet-width direction (direction orthogonal to the conveyance direction of a sheet P). In the following descriptions, in a case where the first to eighth liquid discharge heads 221*a* to 221*h* are not distinguished mutually, each is referred to as the "liquid discharge head 221". The line heads for the other colors each have a similar configuration. In the present embodiment, the eight first to eighth liquid discharge heads 221*a* to 221*h* are disposed in arrangement, but the number of liquid discharge heads 221 is not limited. In the present embodiment, the arrangement of the liquid discharge heads 221 has a staggered pattern, but the arrangement is not limited to this.

A wiping assembly 70 is disposed outside the line heads 220C, 220M, 220Y, and 220K in the sheet-width direction. The wiping assembly 70 mainly includes wiping units 700C, 700M, 700Y, and 700K corresponding to the line heads 220C, 220M, 220Y, and 220K for the colors (hereinafter, unless otherwise specified, each referred to as a wiping unit 700) and the rail members 790.

Each wiping unit 700 including at least a wiping member including a web, moves along the arrangement direction of the plurality of liquid discharge heads 221, to wipe a stain on the nozzle face of a liquid discharge head 221 with the wiping member in contact with the liquid discharge head 221. Each wiping unit 700 is provided at an end portion of the rail member 790. As illustrated in FIG. 3, movement of the rail members 790 in the sheet-width direction moves the wiping units 700, so that each wiping unit 700 can wipe a stain on the nozzle face of a liquid discharge head 221 with the wiping member of the wiping unit 700 in contact with the liquid discharge head 221.

Note that, in the present embodiment, the liquid discharge heads 221 are in the staggered arrangement. Each line head (hereinafter, denoted with reference numeral 220) included in the ink discharger 220, includes a train of first to fourth liquid discharge heads 221*a*, 221*b*, 221*c*, and 221*d* and a train of fifth to eighth liquid discharge heads 221*e*, 221*f*, 221*g*, and 221*h*. According to the present embodiment, the plurality of wiping units 700 is provided corresponding to the head trains. That is, in the present embodiment, two wiping units 700 individually corresponding to two head trains are provided at each line head. However, the present embodiment is not limited to this, for example, one wiping unit 700 can wipe two head trains, collectively.

Figure 4:
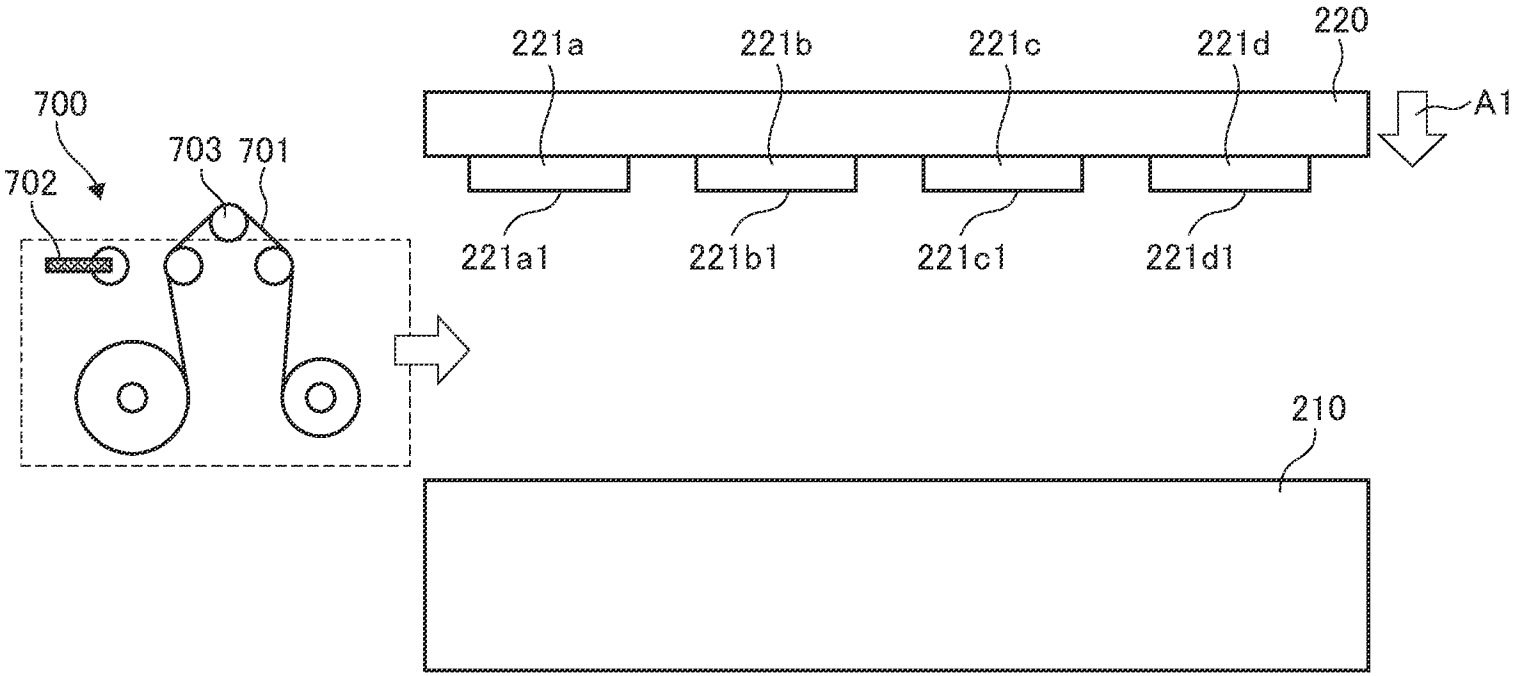
FIG. 4 is an explanatory view of the wiping operation of a wiping unit according to the first embodiment (before a wiping start)
Figure 5:
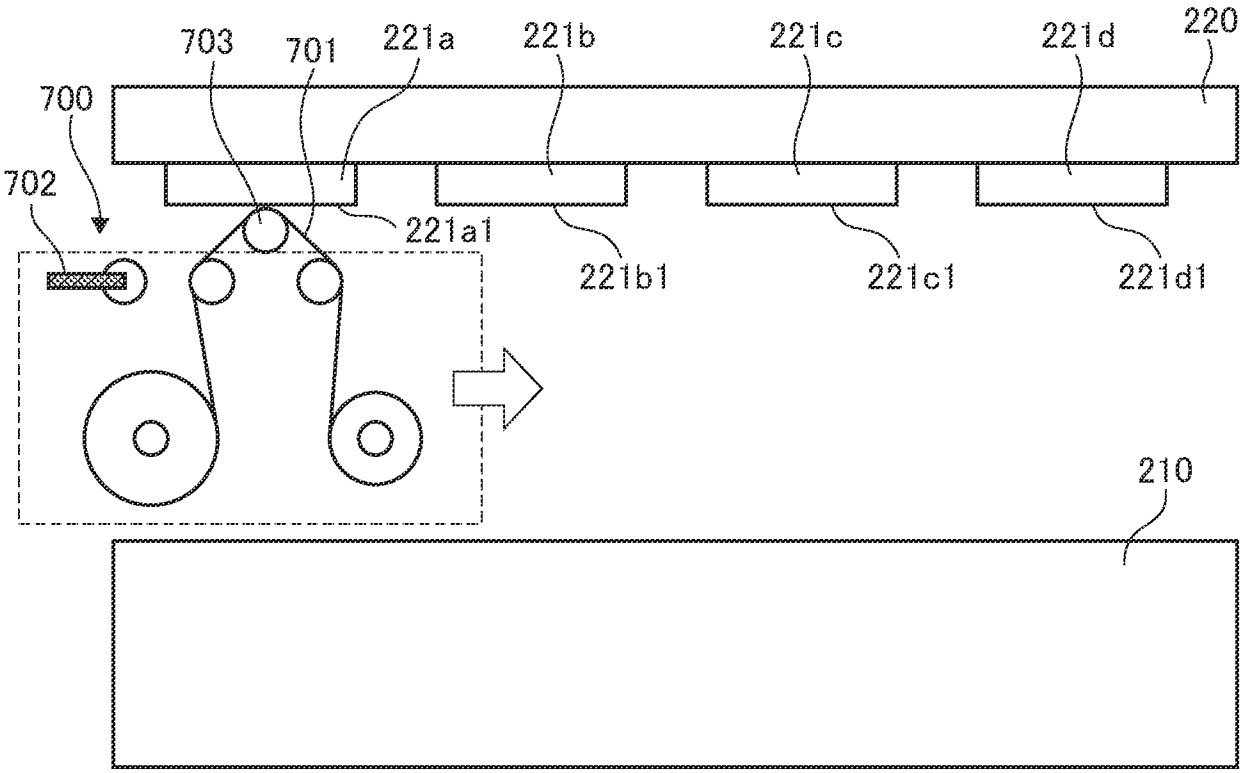
FIG. 5 is an explanatory view of the wiping operation of the wiping unit according to the first embodiment (during web wiping)
Figure 6:
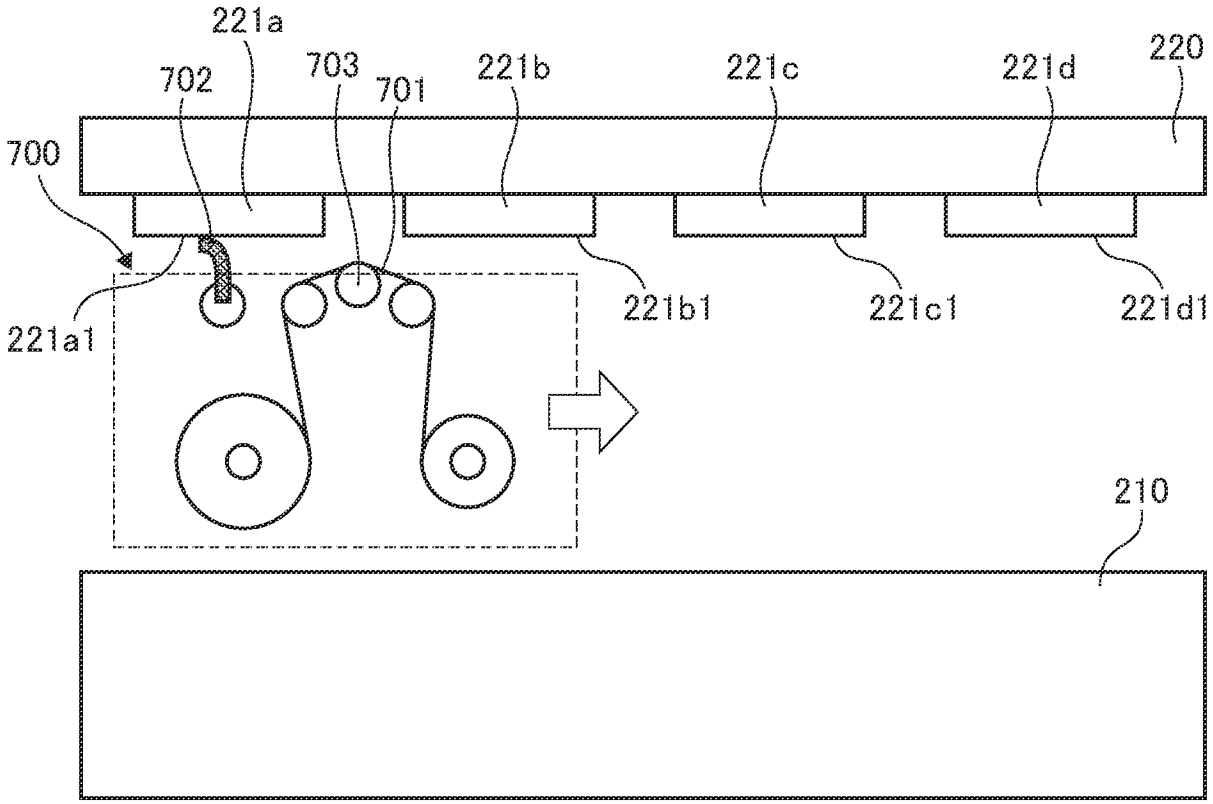
FIG. 6 is an explanatory view of the wiping operation of the wiping unit according to the first embodiment (during wiper wiping)

FIGS. 4, 5, and 6 are each an explanatory view of the wiping operation of a wiping unit 700. FIGS. 4, 5, and 6 illustrate the state before a wiping start, the state during web wiping, and the state during wiper wiping, respectively. FIGS. 4 to 6 are views of the main of the image forming device 200 viewed in the conveyance direction of a sheet P.

As illustrated in FIGS. 2 and 3, the wiping unit 700 is disposed outside the ink discharger 220 in the sheet-width direction (FIG. 4). The wiping unit 700 includes two types of cleaning members, namely, a first wiping member 701 and a second wiping member 702, and a pressing member 703. The first wiping member 701 includes a sheet-shaped member that wipes the respective nozzle faces 221*a*1 to 221*d*1 or 221*e*1 to 221*h*1 of the liquid discharge heads 221 (221*a* to 221*d* or 221*e* to 221*h*). For example, a sheet including an absorbent web is used for the first wiping member 701.

Note that, in a case where the nozzle faces 221*a*1 to 221*h*1 are not distinguished mutually, each is referred to as a "nozzle face 221-1". The second wiping member 702 includes an elastic member that wipes the respective nozzle faces 221-1 of the liquid discharge heads 221. For example, a rubber wiper is used as an unabsorbent blade. The pressing member 703 energizes the first wiping member 701 upward, and presses the first wiping member 701 to the nozzle face 221-1 of a liquid discharge head 221.

Then, as illustrated in FIG. 5, movement of the wiping unit 700 in the sheet-width direction makes the first wiping member 701 included in the wiping unit 700, in contact with the first liquid discharge head 221*a*, so that the nozzle face 221*a*1 of the first liquid discharge head 221*a* can be wiped. Similarly, the nozzle faces 221*b*1 to 221*h*1 of the second to eighth liquid discharge heads 221*b* to 221*h* are wiped. Next, as illustrated in FIG. 6, the first wiping member 701 moves to a retraction position and the second wiping member 702 moves to a wiping position. The movements result in switching between the first wiping member 701 and the second wiping member 702.

Then, movement of the wiping unit 700 in the sheet-width direction (direction orthogonal to the sheet conveyance direction) makes the second wiping member 702 included in the wiping unit 700, in contact with the first liquid discharge head 221*a*, so that the nozzle face 221*a*1 of the first liquid discharge head 221*a* can be wiped. Similarly, the nozzle faces 221*b*1 to 221*h*1 of the second to eighth liquid discharge heads 221*b* to 221*h* are wiped. The movement of the wiping unit 700 in the sheet-width direction is performed by a sheet-width-direction movement drive assembly and a wiping-unit movement motor 552. The control of the sheet-width-direction movement drive assembly and the wiping-unit movement motor 552 is performed through a central processing unit (CPU) 510 and a fourth motor controller 544 to be described later.

In this case, movements of both of the first wiping member 701 and the second wiping member 702 to the wiping positions, enable simultaneous wiping of a nozzle face 221-1. However, for one ink discharger 220 including a plurality of liquid discharge heads 221 arranged, there is a possibility that the first wiping member 701 and the second wiping member 702 come in contact with the liquid discharge heads 221 in front of and behind a head to be wiped. Contact of a wiping member with a liquid discharge head 221 not to be wiped, causes a stain on the nozzle face 221-1 unexpectedly, or trouble, such as a fault in discharging. Thus, the first wiping member 701 and the second wiping member 702 each require individual wiping operation.

Figure 7:
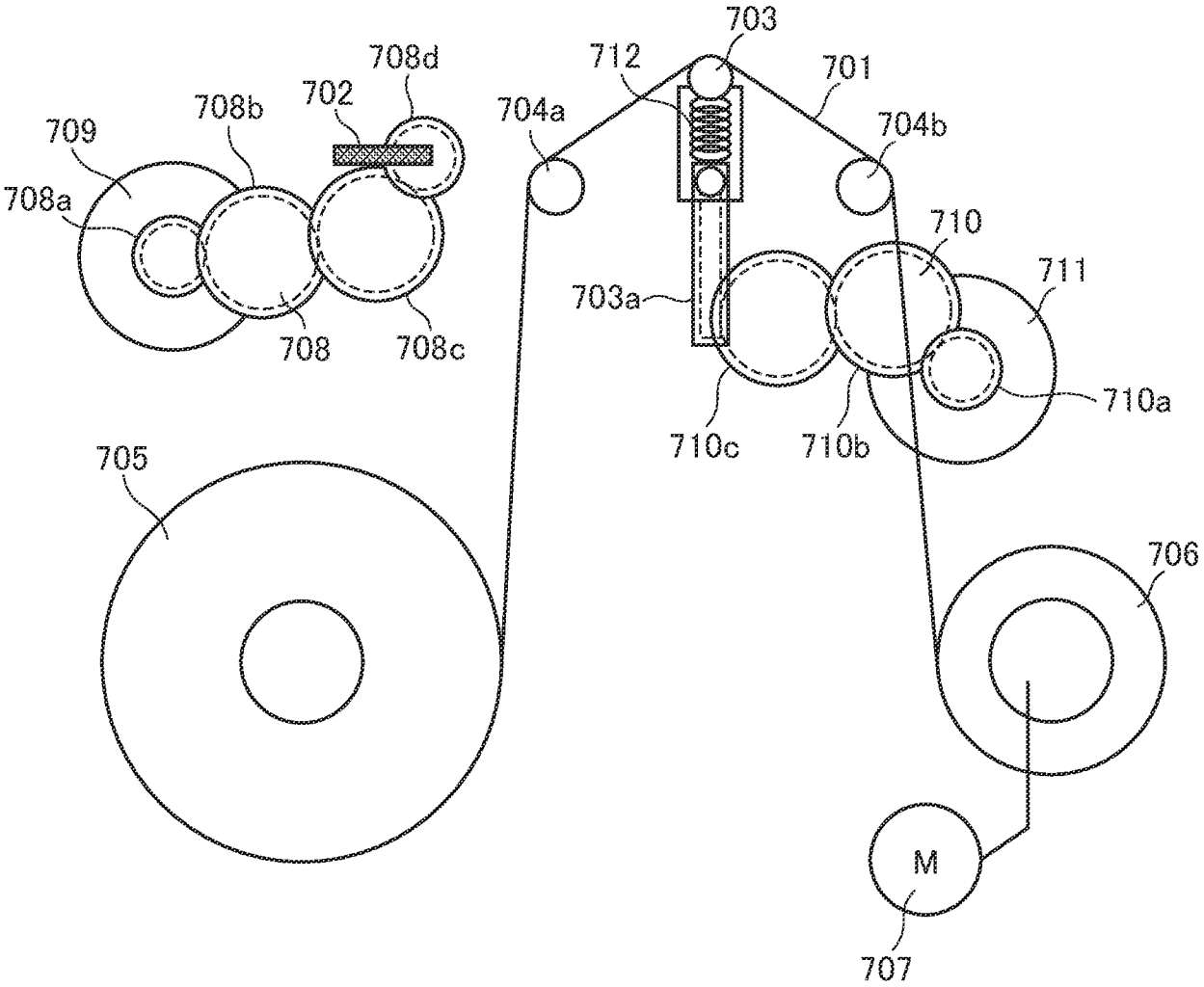
FIG. 7 is an explanatory schematic view of the configuration of a wiping unit that drives a web and a wiper separately, with a first wiping member at a wiping position.
Figure 8:
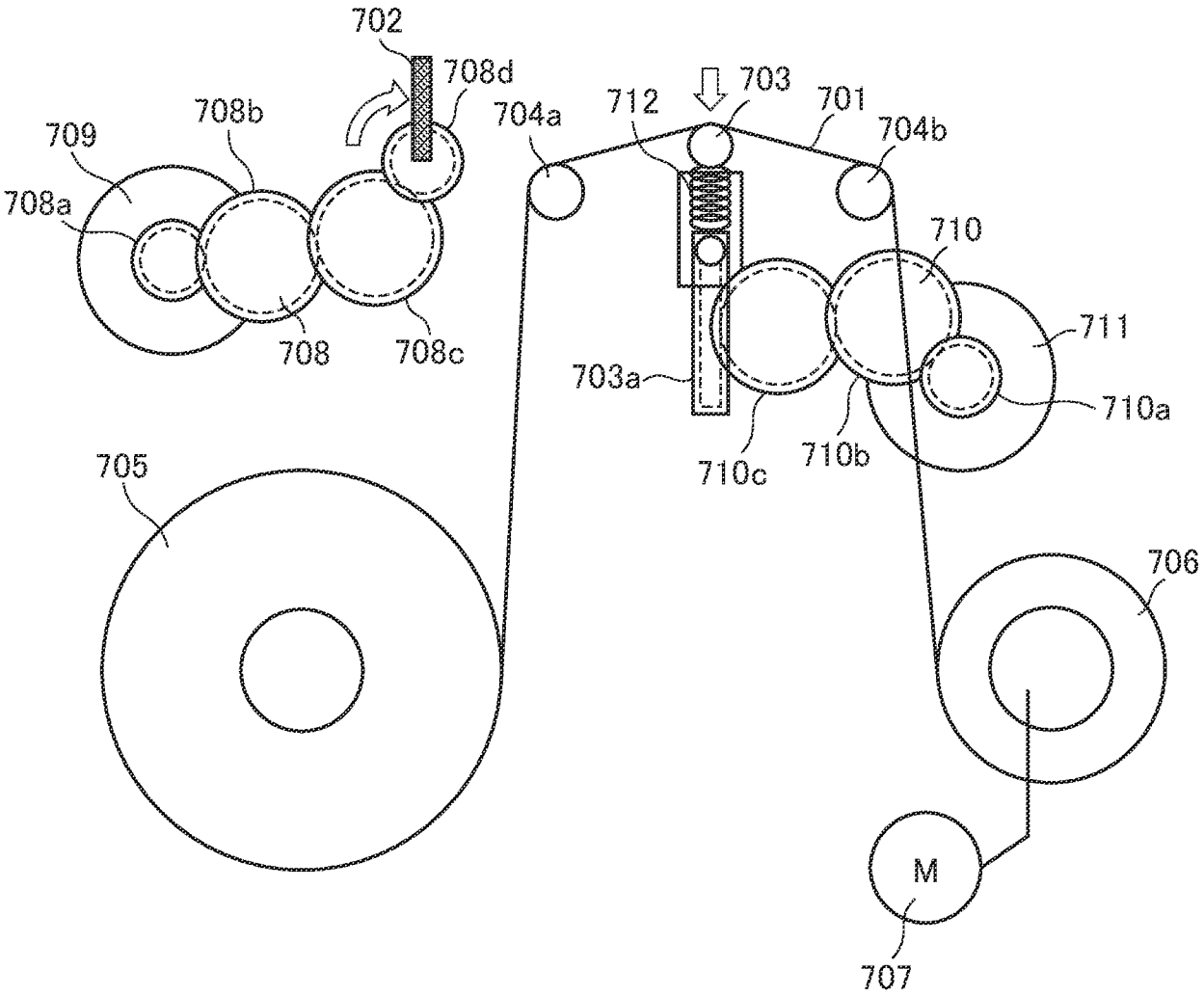
FIG. 8 is an explanatory schematic view of the configuration of the wiping unit that drives the web and the wiper separately, with a second wiping member at a wiping position.
Figure 9:
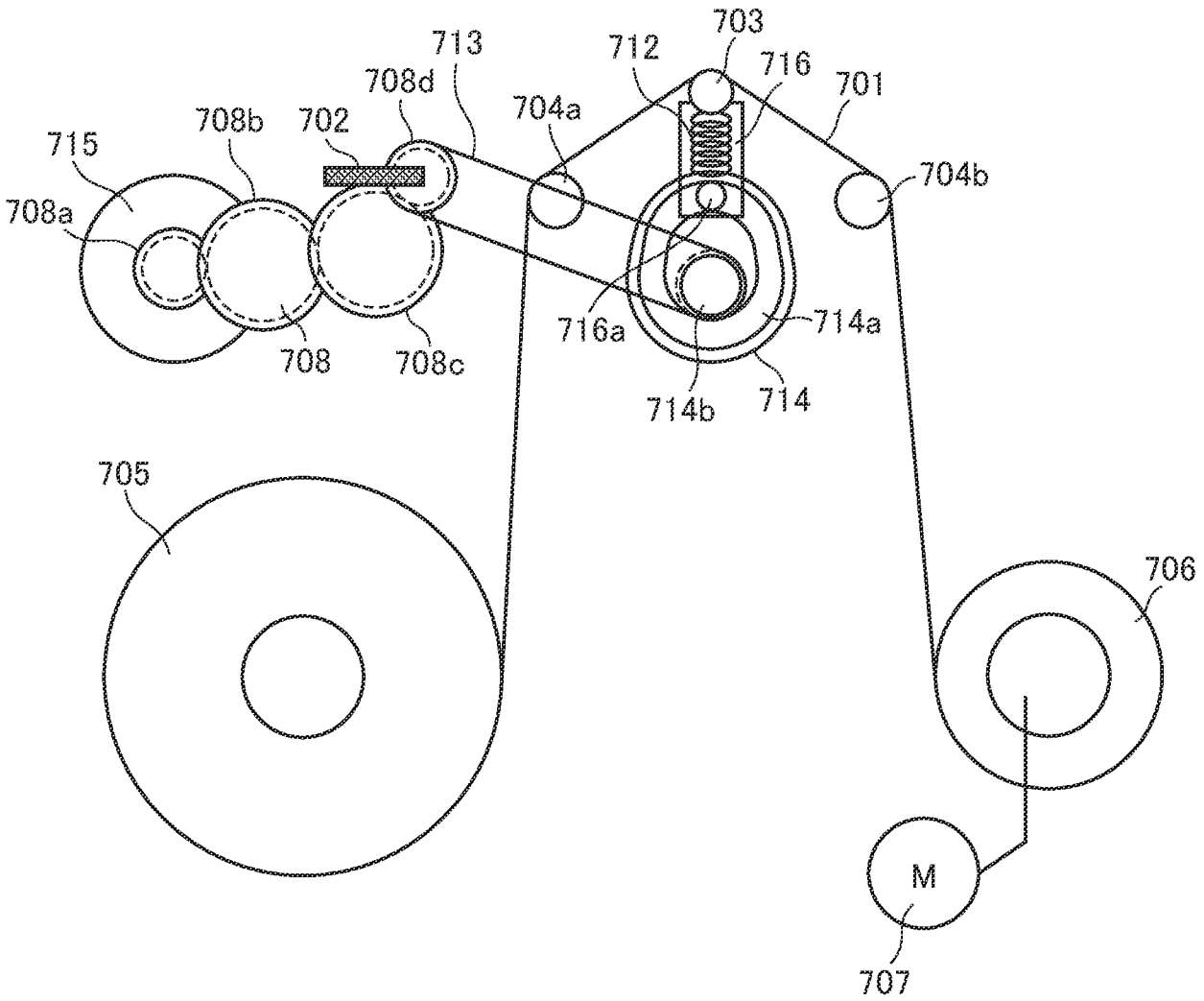
FIG. 9 is an explanatory schematic view of the configuration of a wiping unit according to the first embodiment that drives a web and a wiper with a common drive source, with the web at a wiping position.
Figure 10:
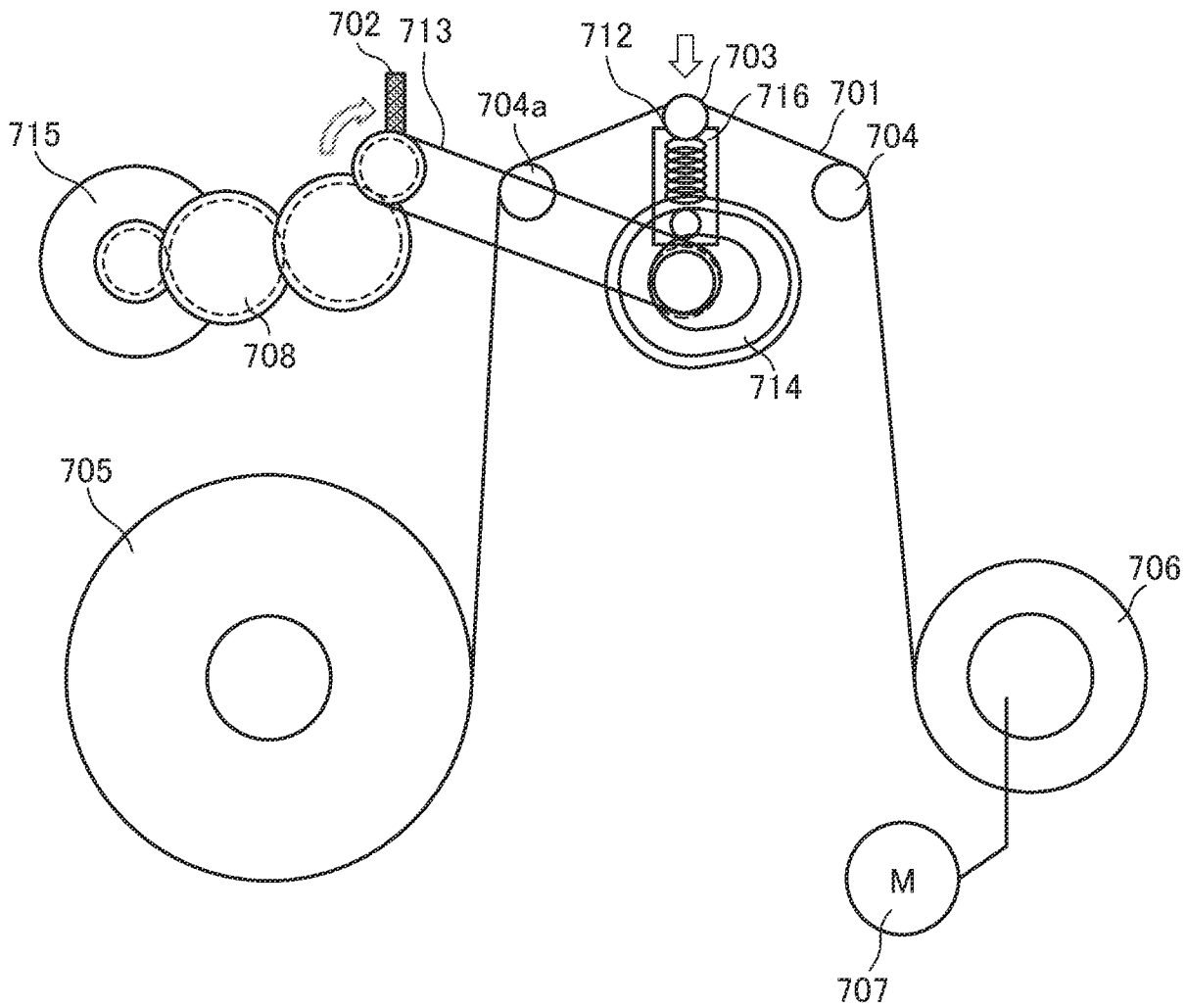
FIG. 10 is an explanatory schematic view of the configuration of the wiping unit according to the first embodiment that drives the web and the wiper with the common drive source, with the wiper at a wiping position.

FIGS. 7 and 8 are explanatory schematic views of the configuration of a wiping unit 700 that drives a first wiping member 701 and a second wiping member 702, separately. FIGS. 9 and 10 are explanatory schematic views of the configuration of a wiping unit 700 according to the present embodiment that drives a first wiping member 701 and a second wiping member 702 with a common (shared) drive source. FIGS. 7 and 9 each illustrate the state when the first wiping member 701 wipes a nozzle face 221-1. FIGS. 8 and 10 each illustrate the state when the second wiping member 702 wipes the nozzle face 221-1.

The first wiping member 701 includes a sheet-shaped member that wipes a nozzle face 221-1. For example, a sheet, such as a web, is used for the first wiping member 701. The second wiping member 702 includes an elastic member that wipes a nozzle face 221-1. For example, a rubber wiper is used for the second wiping member 702. In order to distinguish the two clearly, the first wiping member 701 and the second wiping member 702 will be described below as a web 701 and a wiper 702, respectively.

In FIG. 7, the web 701 is stretched between a feeding roll 705 and a reeling roll 706. A first conveying roller 704*a* and a second conveying roller 704*b* in pairs are disposed on both sides of a pressing member 703 as the center between the feeding roll 705 and the reeling roll 706. With this configuration, a reeling motor 707 drives the reeling roll 706 to reel and convey the web 701 from the feeding roll 705 into the reeling roll 706 through the first conveying roller 704*a*, the pressing member 703, and the second conveying roller 704*b*. This operation enables constant supply of the new face of the web 701 onto the upper portion of the pressing member 703, so that the nozzle face 221-1 can be wiped with the new face of the web 701. A compression spring 712 is disposed at the lower portion of the pressing member 703, the compression spring 712 energizing the web 701 upward. The nozzle face 221-1 is wiped by appropriate pressure due to the elastic force of the compression spring 712. Note that, instead of the compression spring 712, for example, an elastic member, such as rubber, can be used.

The pressing member 703 is capable of elevation operation due to a pressing-member elevation motor 711 in addition to the energization of the compression spring 712. This elevation operation allows switching of the pressing member 703 between a wiping position at which the web 701 wipes the nozzle face 221-1 and a retraction position at which the web 701 is not in contact with the nozzle face 221-1. In the configuration illustrated in FIG. 7, the pressing-member elevation motor 711 elevates the pressing member 703 up and down through a first gear drive train 710.

The first gear drive train 710 includes a first drive gear 710*a* at the first stage coupled with the drive shaft of the pressing-member elevation motor 711, a second intermediate gear 710*b* engaging with the first drive gear 710*a*, and a third driven gear 710*c* at the last stage engaging with the second intermediate gear 710*b*. The third driven gear 710*c* at the last stage engages with a rack 703*a* disposed at the lower end of the compression spring 712. The elevation operation of the pressing member 703 is performed in accordance with the rotation direction of third driven gear 710*c*. Note that, in the present embodiment, the pressing-member elevation motor 711 and the first gear drive train 710 that elevate the pressing member 703 up and down, are disposed on the reeling roll 706 side with respect to the pressing member 703.

The wiper 702 is coupled with the driving of a wiper rotation motor 709 through a second gear drive train 708. The wiper 702 can be rotated by the wiper rotation motor 709. This rotation allows switching of the wiper 702 between a wiping position at which the wiper 702 wipes the nozzle face 221-1 and a retraction position at which the wiper 702 is not in contact with the nozzle face 221-1.

The second gear drive train 708 includes a second drive gear 708*a* at the first stage coupled with the drive shaft of the wiper rotation motor 709, a second intermediate gear 708*b* engaging with the second drive gear 708*a*, a third intermediate gear 708*c* engaging with the second intermediate gear 708*b*, and a wiper rotation shaft 708*d* at the last stage including a second driven gear engaging with the third intermediate gear 708*c*. The wiper 702 is rotatable with the wiper rotation shaft 708*d*. The wiper 702 is set at the wiping position or the retraction position by rotation of the wiper rotation shaft 708*d*.

Provision of the two drive sources in this manner, allows individually the switching operation of the pressing member 703 between the wiping position and the retraction position and the switching operation of the wiper 702 between the wiping position and the retraction position. Thus, a wiping member avoids coming in contact with a head not to be wiped. Depending on the state of the nozzle face 221-1 or a mode of cleaning, in a case where wiping is performed with only the web 701 or in a case where wiping is performed with only the wiper 702, for example, a mode of performing wiping with the wiper 702 after wiping with the web 701 or a mode of performing wiping with the web 701 after wiping with the wiper 702 selectively operates.

The example in which the two drive sources, namely, the wiper rotation motor 709 performs the switching operation of the wiper 702 between the wiping position and the retraction position and the pressing-member elevation motor 711 performs the switching operation of the pressing member 703 between the wiping position and the retraction position, has been given above, corresponding to the present embodiment.

In contrast to this, according to the present embodiment, a common wiping switching motor 715 performs the switching operation of the wiper 702 between a wiping position and a retraction position and the switching operation of the pressing member 703 between a wiping position and a retraction position, to wipe the nozzle face 221-1.

In FIG. 9, the wiping switching motor 715 couples driving with the wiper 702 through a second gear drive train 708. Furthermore, a wiper rotation shaft 708*d* couples the driving with a camshaft (hereinafter, referred to as a first camshaft) 714*b* of a pressing-member elevation cam 714 through a timing belt 713. The ratio between the turn of the wiper 702 and the rotation of the first camshaft 714*b* of the pressing-member elevation cam 714, is one to one. A turn of 90° of the wiper 702 by the wiping switching motor 715 rotates the pressing-member elevation cam 714 by 90° in synchronization as illustrated in FIG. 10. The pressing-member elevation cam 714 has a cam groove (hereinafter, referred to as a first cam groove) 714*a*. A protrusion (hereinafter, referred to as a first protrusion) 716*a* provided in a pressing-member holder 716 is inserted in the first cam groove 714*a* or is engaged with the first cam groove 714*a*, so that the first protrusion 716*a* functions as a cam follower. Note that the driving of the wiping switching motor 715 is controlled by the CPU 510 and a first motor controller 541 in control circuitry 500 to be described later.

The pressing-member holder 716 is guided movably only upward and downward. The pressing-member holder 716 descends in response to the trajectory of the first protrusion 716*a* moving along the first cam groove 714*a* of the pressing-member elevation cam 714 rotating, resulting in movement of the pressing member 703 to the retraction position. In the configuration illustrated in FIGS. 9 and 10, rotation of the pressing-member elevation cam 714 by 90° from the position of FIG. 9, causes the pressing member 703 to descend and move to the retraction position illustrated in FIG. 10.

The ratio between the turn of the wiper 702 and the rotation of the pressing-member elevation cam 714, is not necessarily one to one, and thus can be flexibly set meeting the shape of the pressing-member elevation cam 714, on the basis of the convenience of layout or a desirable operation pattern. In the configuration illustrated in FIGS. 9 and 10, the wiper rotation shaft 708*d* couples driving with the first camshaft 714*b* of the pressing-member elevation cam 714 through the timing belt 713. However, instead of the timing belt 713, for example, a gear or a wire capable of driving coupling, can be applied. Note that the configuration of the second gear drive train 708 is the same as the configuration described with reference to FIG. 7.

The configuration in this manner does not require the pressing-member elevation motor 711, the first gear drive train 710, and the rack 703*a* illustrated in FIGS. 7 and 8, so that the wiping switching motor 715 is provided as a common drive source. As a result, the number of components can be reduced, so that a reduction in costs and miniaturization of an apparatus can be achieved. The web 701 and the wiper 702 wipe the nozzle face 221-1, so that cleaning effect improves.

According to the present embodiment, driving the wiping switching motor 715 as the drive source causes the wiper rotation shaft 708*d* as a first rotary body to be driven in synchronization with the pressing-member holder 716. Accordingly, the linear motion of the first wiping member 701 and the rotational motion of the second wiping member 702 can be synchronously executed with a simple configuration.

Second Embodiment

Figure 11:
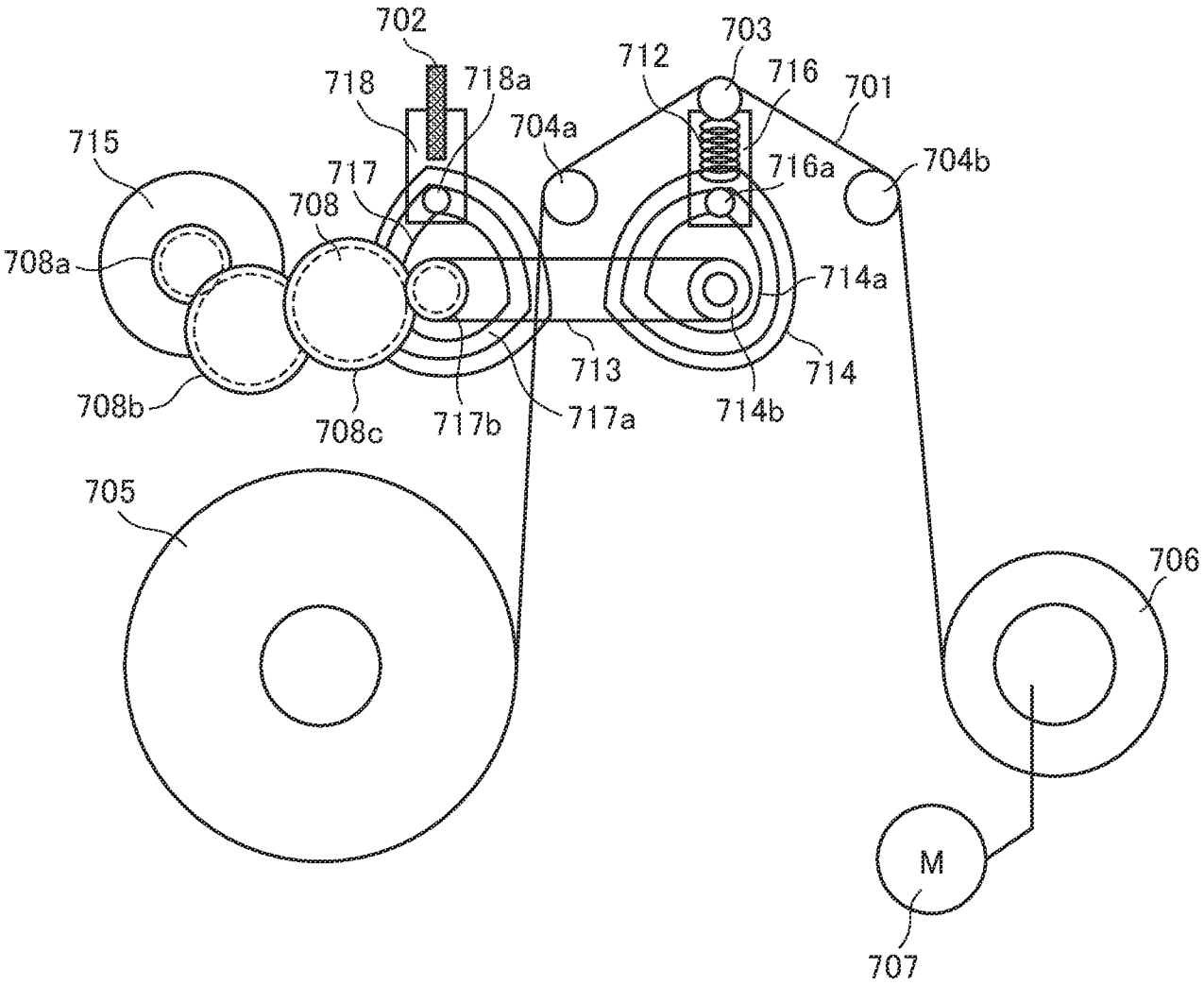
FIG. 11 is an explanatory schematic view of the configuration of a wiping unit according to a second embodiment that drives a web and a wiper with common drive source.
Figure 12:
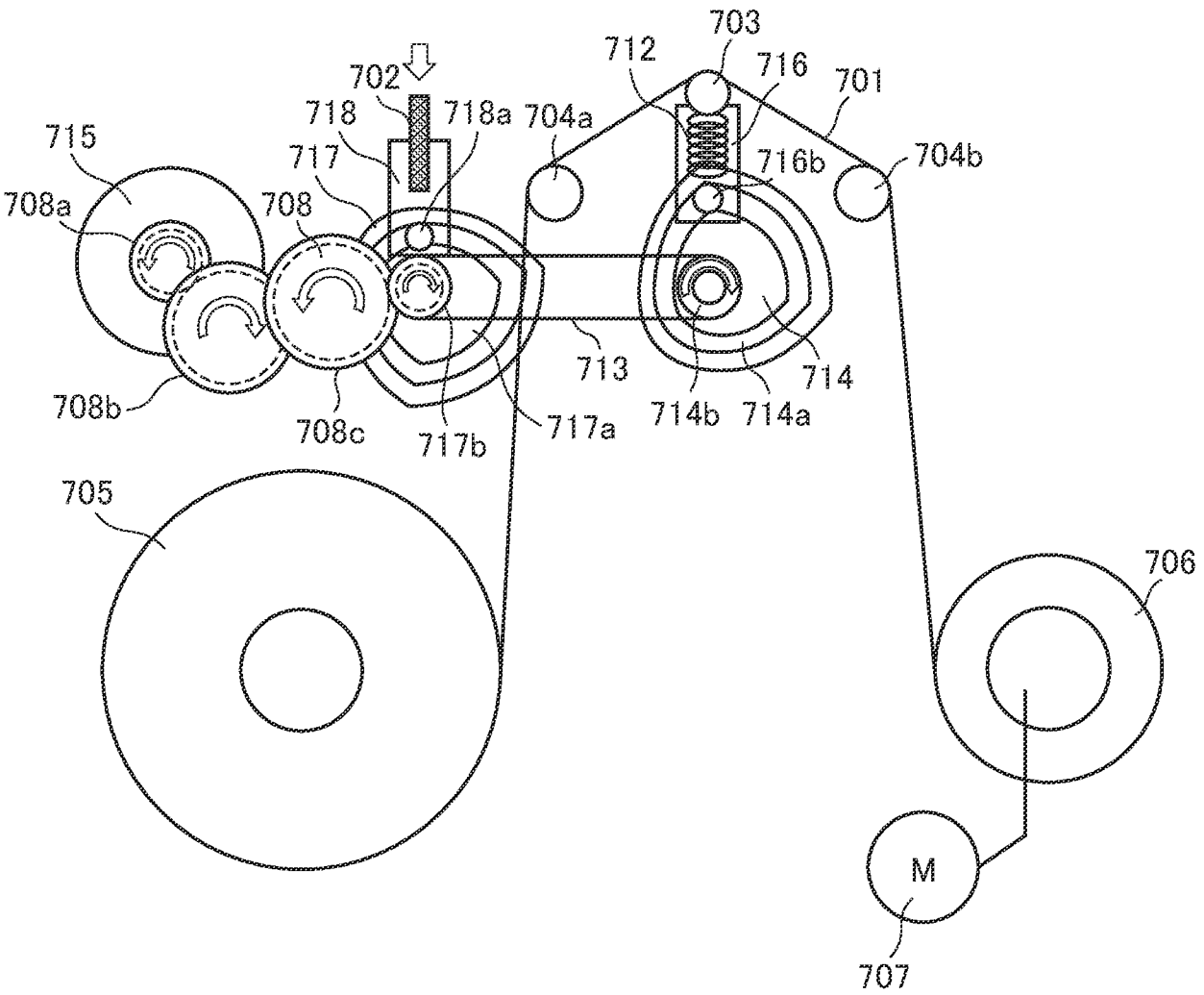
FIG. 12 is an explanatory schematic view of the configuration of the wiping unit according to the second embodiment that drives the web and the wiper with the common drive source, with the web at a wiping position.
Figure 13:
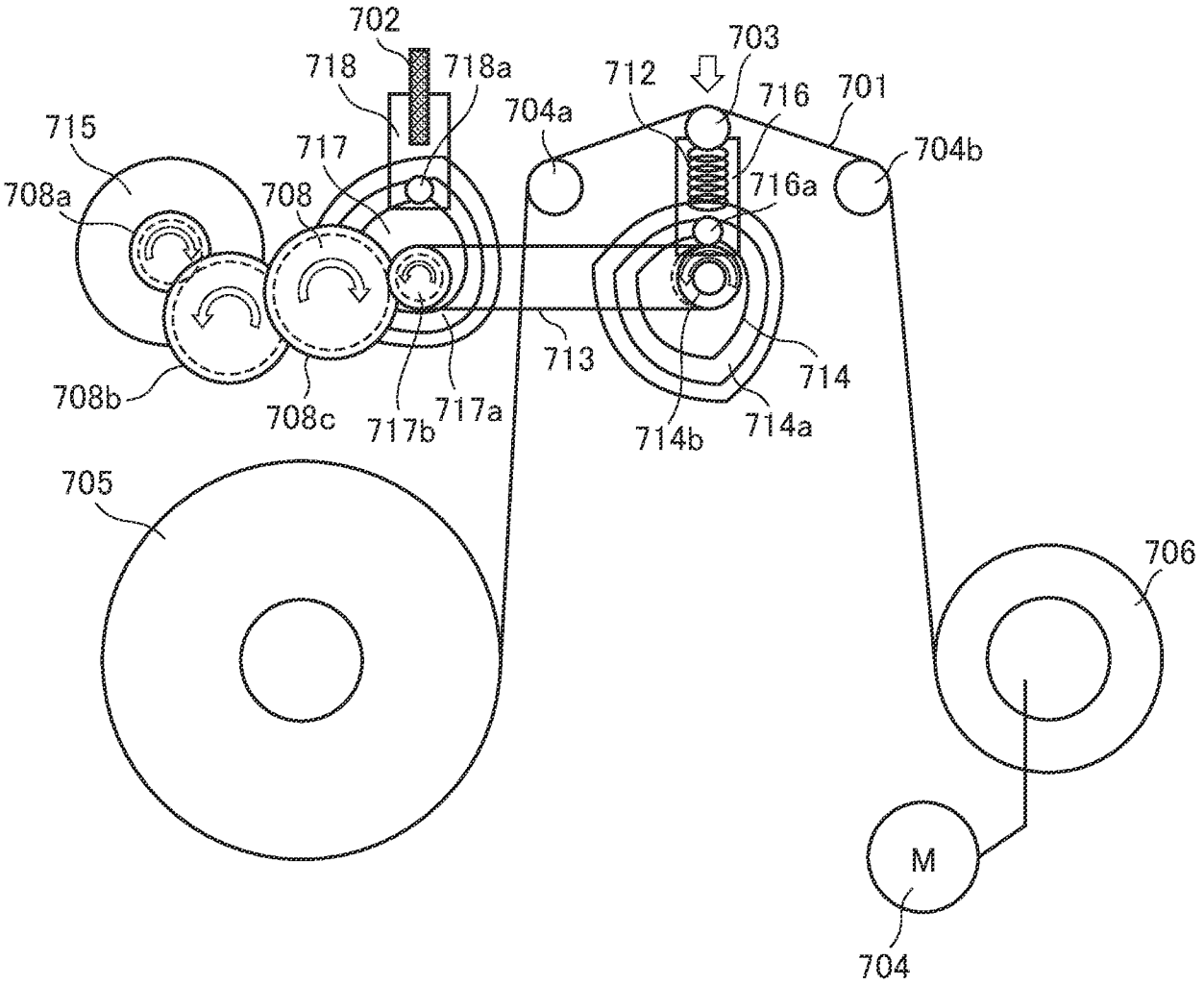
FIG. 13 is an explanatory schematic view of the configuration of the wiping unit according to the second embodiment that drives the web and the wiper with the common drive source, with the wiper at a wiping position.

FIGS. 11 to 13 are explanatory schematic views of the configuration of a wiping unit 700 according to a second embodiment that drives a web 701 and a wiper 702 with one drive source.

According to the first embodiment illustrated in FIGS. 9 and 10, the rotation allows the wiper 702 to switch between the wiping position and the retraction position, and the elevation allows the pressing member 703 to switch between the wiping position and the retraction position. In contrast to this, the wiper 702 may perform elevation, and the pressing member 703 may perform rotation. Alternatively, the wiper 702 and a pressing member 703 may each perform elevation operation as illustrated in FIGS. 11 to 13. These can be flexibly selected depending on layout circumstances. Thus, according to the second embodiment, a wiper elevation cam 717 performs the elevation operation of the wiper 702, and a pressing-member elevation cam 714 performs the elevation operation of the pressing member 703.

As illustrated in FIG. 11, according to the second embodiment, a camshaft (hereinafter, referred to as a second camshaft) 717*b* of the wiper elevation cam 717 is used, instead of the wiper rotation shaft 708*d* in the first embodiment. The second camshaft 717*b* functions as a second driven gear, similarly to the first embodiment, and couples driving with a first camshaft 714*b* of the pressing-member elevation cam 714 through the timing belt 713.

The wiper elevation cam 717 includes a second cam groove 717*a* and the second camshaft 717*b*. The second camshaft 717*b* is the center in rotation of the wiper elevation cam 717. The wiper elevation cam 717 is integrally secured with the second camshaft 717*b*. A wiping switching motor 715 transmits drive force to the second camshaft 717*b* through a second gear drive train 708. The drive force is further transmitted to the first camshaft 714*b*.

A wiper holder 718 holds the wiper 702 having an upper portion protruding from the wiper holder 718. A protrusion (hereinafter, referred to as a second protrusion) 718*a* provided at the lower portion of the wiper holder 718, is inserted in the second cam groove 717*a* or is engaged with the second cam groove 717*a*, so that the second protrusion 718*a* functions as a cam follower. This assembly allows the wiper holder 718 to ascend and descend due to rotation of the wiper elevation cam 717, resulting in elevation operation of the wiper 702. For the elevation operation of the pressing member 703, because a first protrusion 716*a* of a pressing-member holder 716 is inserted in a first cam groove 714*a* of the pressing-member elevation cam 714, the pressing-member holder 716 ascends and descends in response to rotation of the pressing-member elevation cam 714, resulting in elevation operation of the pressing member 703.

In this case, depending on the shape of a cam, as illustrated in FIGS. 12 and 13, the elevation operation of the wiper 702 and the elevation operation of the pressing member 703 can be individually performed by switching between the normal rotation and the reverse rotation of the wiping switching motor 715. Switching between the objects that perform elevation operation, by the normal rotation and the reverse rotation, allows change of the speed in rotation of the wiping switching motor 715 between the normal rotation and the reverse rotation, so that the speed of elevation operation of each object can be changed. For example, the rotation speed of the wiping switching motor 715 is changed so as to slow the speed of either the normal rotation or the reverse rotation, whichever is higher in drive load, so that the burden on motor torque can be reduced. Thus, an inexpensive motor can be selected. Increase of the speed of either the normal rotation or the reverse rotation, whichever is smaller in load, can shorten operating time. In the present embodiment, the control of the wiping switching motor 715 is performed by a CPU 510 and a fourth motor controller 544 as to be described later.

Note that FIG. 12 illustrates the state of each constituent element when the wiper 702 descends or moves backward (moves to the retraction position) with the pressing member 703 that has ascended (wiping position). Conversely, FIG. 13 illustrates the state of each constituent element when the pressing member 703 descends or moves backward (moves to the retraction position) with the wiper 702 that has ascended (wiping position). For the former state, the wiping switching motor 715 rotates counterclockwise as illustrated. For the latter state, the wiping switching motor 715 rotates clockwise as illustrated. Note that the pressing-member elevation cam 714 and the wiper elevation cam 717 are appropriately designed in cam shape and cam size, on the basis of operation. For example, in the present embodiment, cams in the same size and in the same shape are disposed at mutually different angles, so that the pressing-member elevation cam 714 and the wiper elevation cam 717 can be implemented.

In terms of assembly, the second camshaft 717*b*, the wiper elevation cam 717, and the wiper 702 held by the wiper holder 718 in the second embodiment are equivalent to the wiper rotation shaft 708*d* and the wiper 702 in the first embodiment. The other constituent elements that have not been described specifically are the same in configuration as the constituent elements according to the first embodiment, and function similarly to the constituent elements according to the first embodiment.

Figure 24:
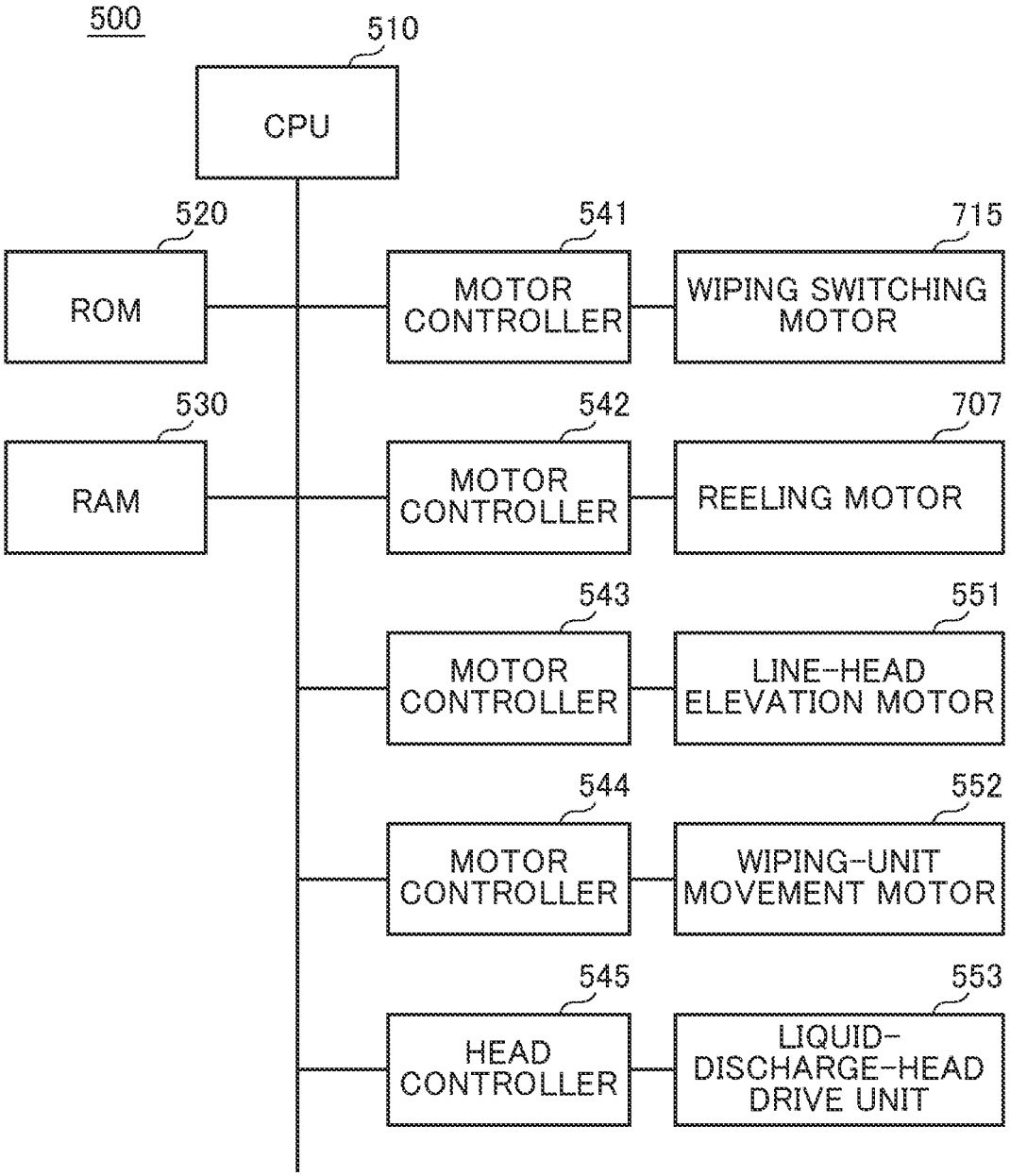
FIG. 24 is a block diagram of a control configuration according to the second embodiment.

FIGS. 14 to 20 are explanatory operation views of the wiping operation of the wiping unit 700 for the nozzle face 221*b*1 of a second liquid discharge head 221*b* in the second embodiment. The second liquid discharge head 221*b* is a head second from the sheet end portion illustrated in FIG. 2. The wiping operation will be described below with reference to a block diagram of a control configuration of FIG. 24 and a flowchart of FIG. 25.

Figure 15:
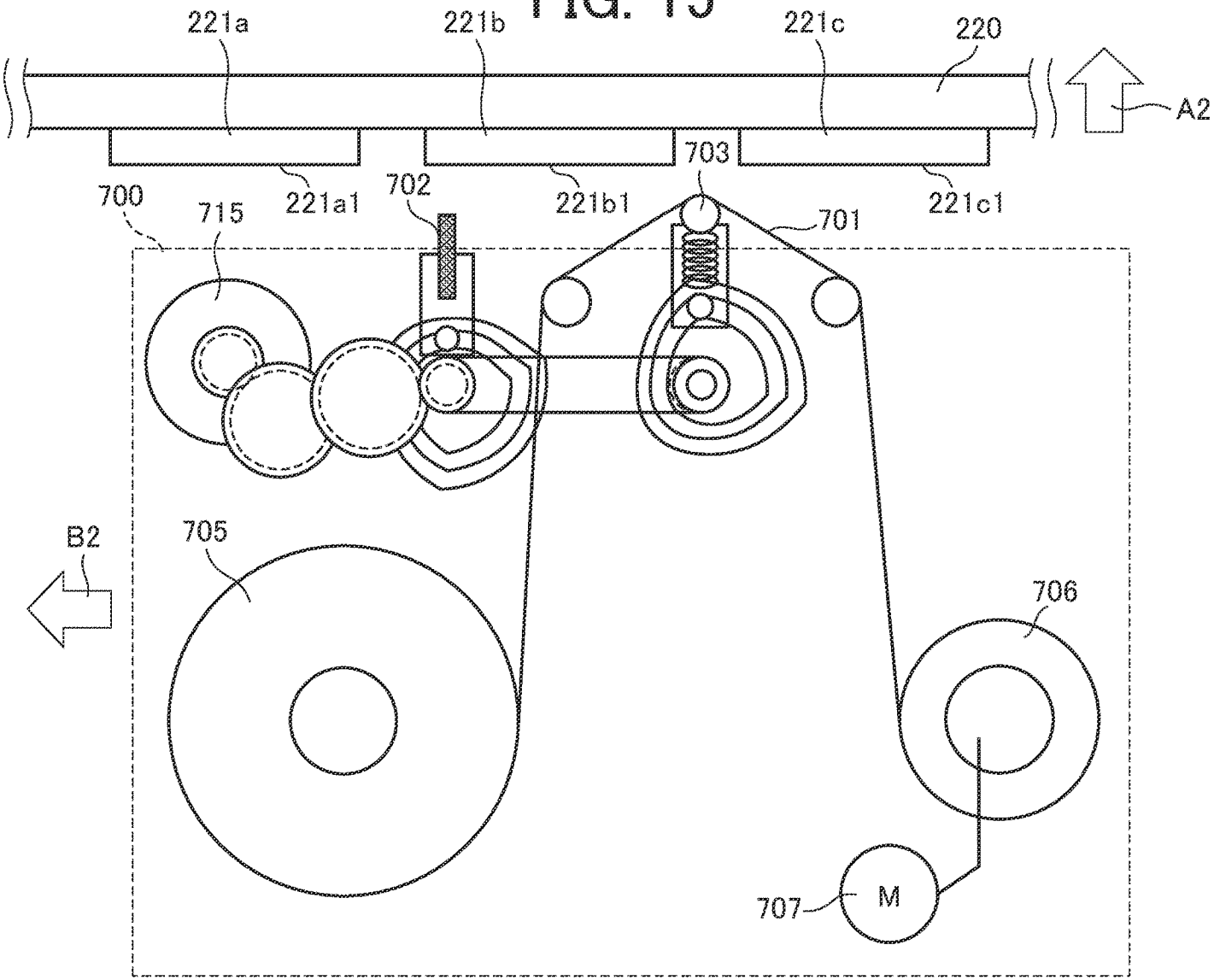
FIG. 15 is an explanatory operation view of the web and the wiper retracted from the nozzle face of the liquid discharge head in the second embodiment.

In a case where the web 701 wipes the nozzle face 221*b*1 of the second liquid discharge head 221*b*, first, the pressing member 703 is positioned at a wiping start position for the second liquid discharge head 221*b*. The wiping start position is located between the first liquid discharge head 221*a* and the second liquid discharge head 221*b*. FIG. 15 illustrates a wiping completion position at which the pressing member 703 is positioned between the second liquid discharge head 221*b* and the third liquid discharge head 221*c*. This state corresponds to a wiping start position for the third liquid discharge head 221*c*. Therefore, for the second liquid discharge head 221*b*, the state where the pressing member 703 is positioned between the first liquid discharge head 221*a* and the second liquid discharge head 221*b*, corresponds to the wiping start position for the second liquid discharge head 221*b*.

In this state, the ink discharger 220 has retracted in the arrow A2 direction. The wiping switching motor 715 rotates normally (rotates in a previously set one direction) such that the pressing member 703 is positioned at the wiping position and the wiper 702 is positioned at the retraction position. After the pressing member 703 is positioned at the wiping position and the wiper 702 is positioned at the retraction position due to this normal-rotation operation, the wiping switching motor 715 stops rotating due to the control of the CPU 510.

Then, for wiping of the second liquid discharge head 221*b*, the CPU 510 first verifies whether the ink discharger 220 has retracted at the retraction position (step S1). When verifying that the ink discharger 220 has retracted (step S1: Y), the CPU 510 verifies whether the pressing member 703 is positioned at the wiping start position for the nozzle face 221*b*1 of the second liquid discharge head 221*b* between the first liquid discharge head 221*a* and the second liquid discharge head 221*b* (step S2).

When verifying that the pressing member 703 is positioned at the wiping start position (step S2: Y), the CPU 510 further verifies whether the pressing member 703 is positioned at the wiping position and the wiper 702 is positioned at the retraction position (step S3), to determine whether wiping is allowable. Note that, on the basis of the rotation angle of the wiping switching motor 715, the CPU 510 can determine whether the pressing member 703 is positioned at the wiping position and the wiper 702 is positioned at the retraction position.

When it is determined that wiping is allowable, a line-head elevation motor 551 drives a line-head elevation assembly to cause the ink discharger 220 to descend to the wiping position (step S4: corresponding to the arrow A1 direction). The line-head elevation assembly is an assembly to be driven by the CPU 510 through a motor controller 543. The elevation assembly itself can be appropriately provided by a person skilled in the art with a cam or a gear, and thus the detailed description of the elevation assembly will be omitted.

When the ink discharger 220 descends to the wiping position (step S5: Y), a wiping-unit movement motor 552 drives a sheet-width-direction movement drive assembly to move the wiping unit 700 in the sheet width direction (arrow B1 direction) (step S6). The sheet-width-direction movement drive assembly is an assembly to be driven by the CPU 510 through the motor controller 544. Similarly to the elevation assembly, the movement drive assembly itself can be appropriately provided by a person skilled in the art with a cam or a gear, and thus the detailed description of the movement drive assembly will be omitted.

Figure 14:
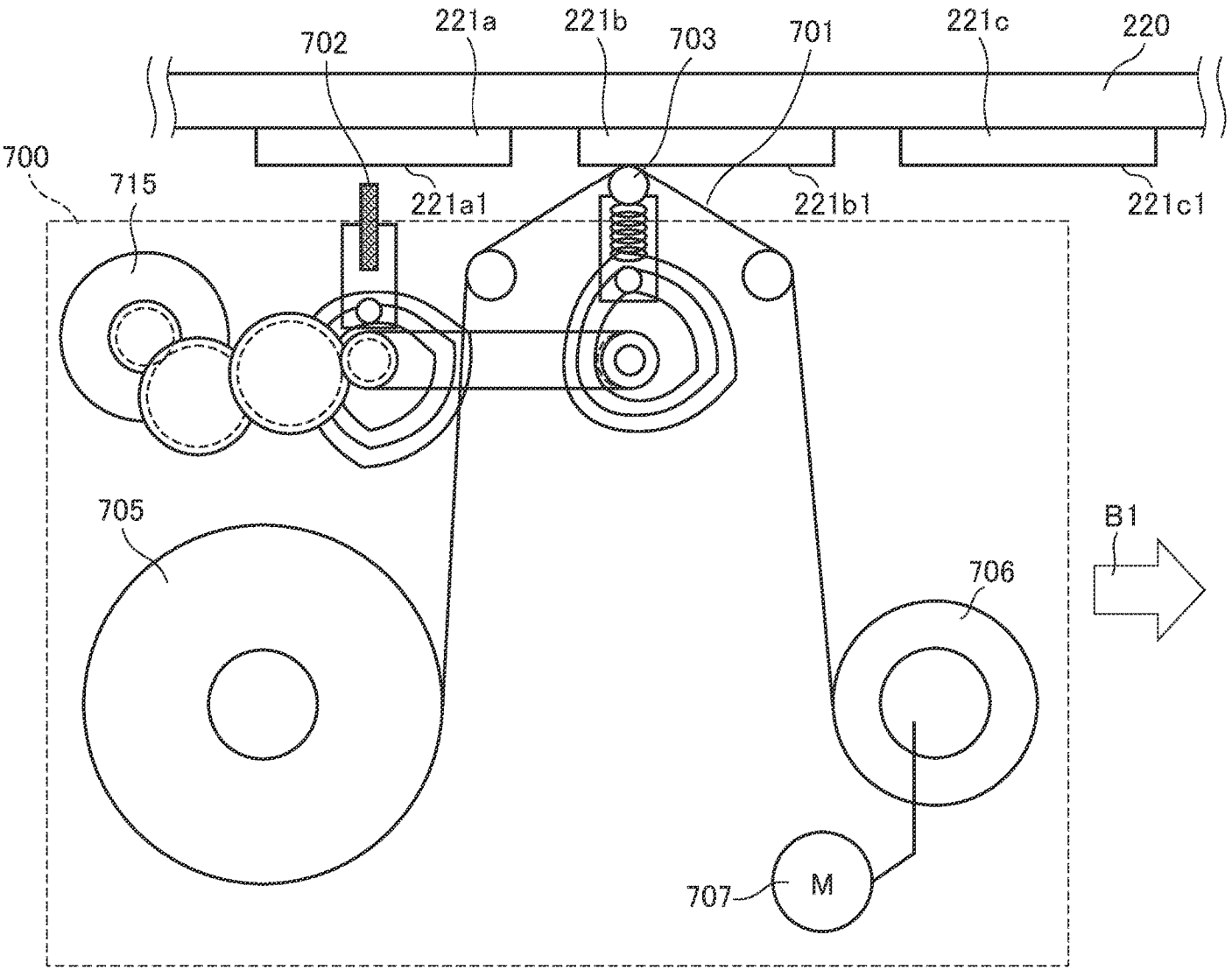
FIG. 14 is an explanatory operation view of the wiping operation of the web on the nozzle face of a liquid discharge head in the second embodiment.

FIG. 14 illustrates the movement state in the wiping direction, namely, in the arrow B1 direction of the pressing member 703 at step S6. As illustrated in FIG. 14, the wiping unit 700 moves in the arrow B1 direction with the web 701 in contact with or pressing against the nozzle face 221*b*1 of the second liquid discharge head 221*b*. Thus, the wiping unit 700 moves with the web 701 in contact with the nozzle face 221*b*1 due to the pressing member 703, to wipe the nozzle face 221*b*1. At this time, because the wiper 702 is positioned at the retraction position at which the wiper 702 is not in contact with the first liquid discharge head 221*a*, only the web 701 wipes the nozzle face 221*b*1.

After the pressing member 703 moves to the end portion of the nozzle face 221*b*1 of the second liquid discharge head 221*b* and the wiping with the web 701 is completed (step S7: Y), as illustrated in FIG. 15, the pressing member 703 is positioned between the second liquid discharge head 221*b* and the third liquid discharge head 221*c*. After this state, the ink discharger 220 ascends (arrow A2 direction) and moves to the retraction position spaced apart from the pressing member 703 by a predetermined distance (step S8).

As illustrated in FIG. 15, when the pressing member 703 arrives at a position at which the wiping of the nozzle face 221*b*1 of the second liquid discharge head 221*b* is completed, the wiper 702 is positioned being opposed to the second liquid discharge head 221*b*. That is the wiper 702 is positioned slightly on the third liquid discharge head 221*c* side with respect to the end portion on the first liquid discharge head 221*a* side of the second liquid discharge head 221*b*. Thus, if the wiper 702 starts wiping operation in this state, an unwiped area occurs.

Figure 16:
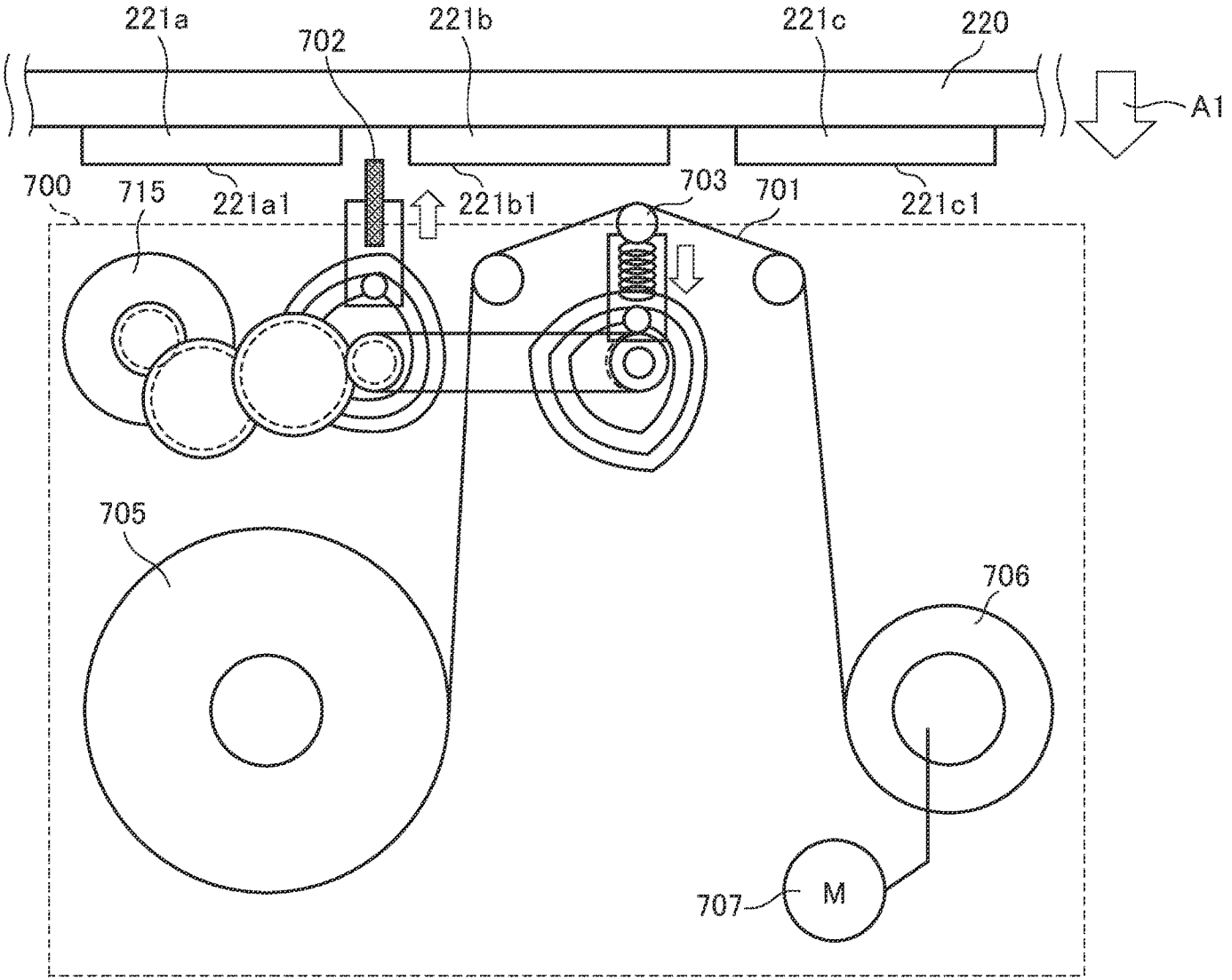
FIG. 16 is an explanatory operation view just before the wiper starts wiping operation after an advance of the wiper between adjacent liquid discharge nozzles of the liquid discharge head, in the second embodiment.

Therefore, as illustrated in FIGS. 15 and 16, the wiper 702 is moved backward to a position corresponding to the wiping start position of the pressing member 703 to the second liquid discharge head 221*b*. That is the wiping-unit movement motor 552 is driven to move the wiping unit 700 in the arrow B2 direction from the position illustrated in FIG. 15 to the position illustrated in FIG. 16 (step S9).

Then, the wiping switching motor 715 rotates by a predetermined angle in the opposite direction to the direction in which the state of FIG. 14 is acquired (step S10), to position the wiper 702 at the wiping position and the pressing member 703 at the retraction position (step S11: Y). From this state, the line-head elevation motor 551 is driven to cause the ink discharger 220 to descend (move) to the wiping position (step S12). After the ink discharger 220 moves to the wiping position, as illustrated in FIG. 16, the wiper 702 protrudes between the first liquid discharge head 221*a* and the second liquid discharge head 221*b*, and the pressing member 703 has moved backward to a position at which the pressing member 703 is not in contact with the nozzle face 221*b*1. This position is the wiping start position of the wiper 702.

Figure 17:
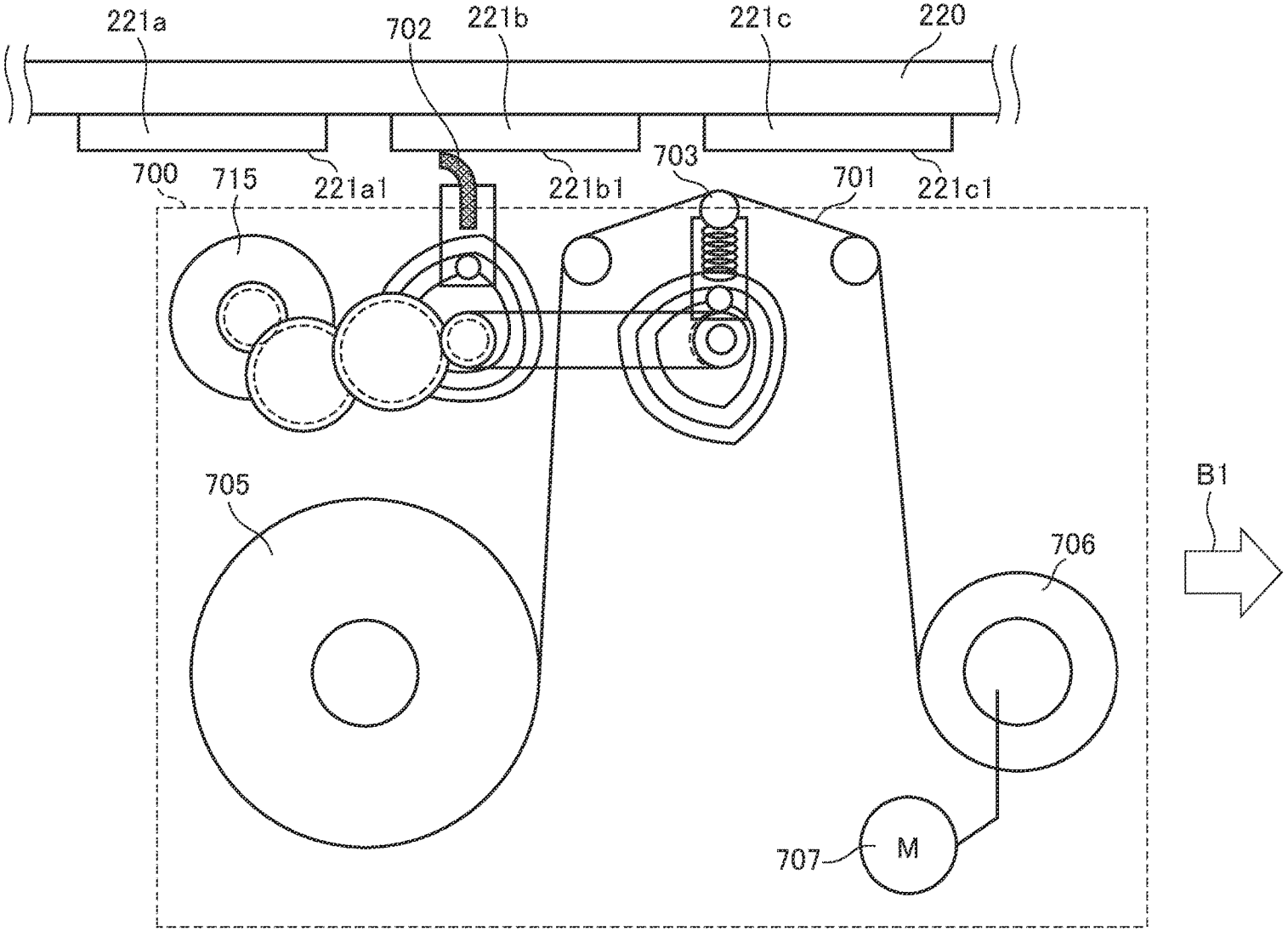
FIG. 17 is an explanatory operation view of the wiper wiping the nozzle face of the liquid discharge head in the second embodiment.

When the wiper 702 is positioned at the wiping start position (step S13: Y), as illustrated in FIG. 17, the wiping-unit movement motor 552 is driven to move the wiping unit 700 in the arrow B1 direction (step S14). At this time, the wiper 702 deforms elastically in contact with the nozzle face 221*b*1. Thus, the nozzle face 221*b*1 is wiped along with the movement of the wiping unit 700, so that cleaning with the wiper 702 is performed to the nozzle face 221*b*1.

Figure 18:
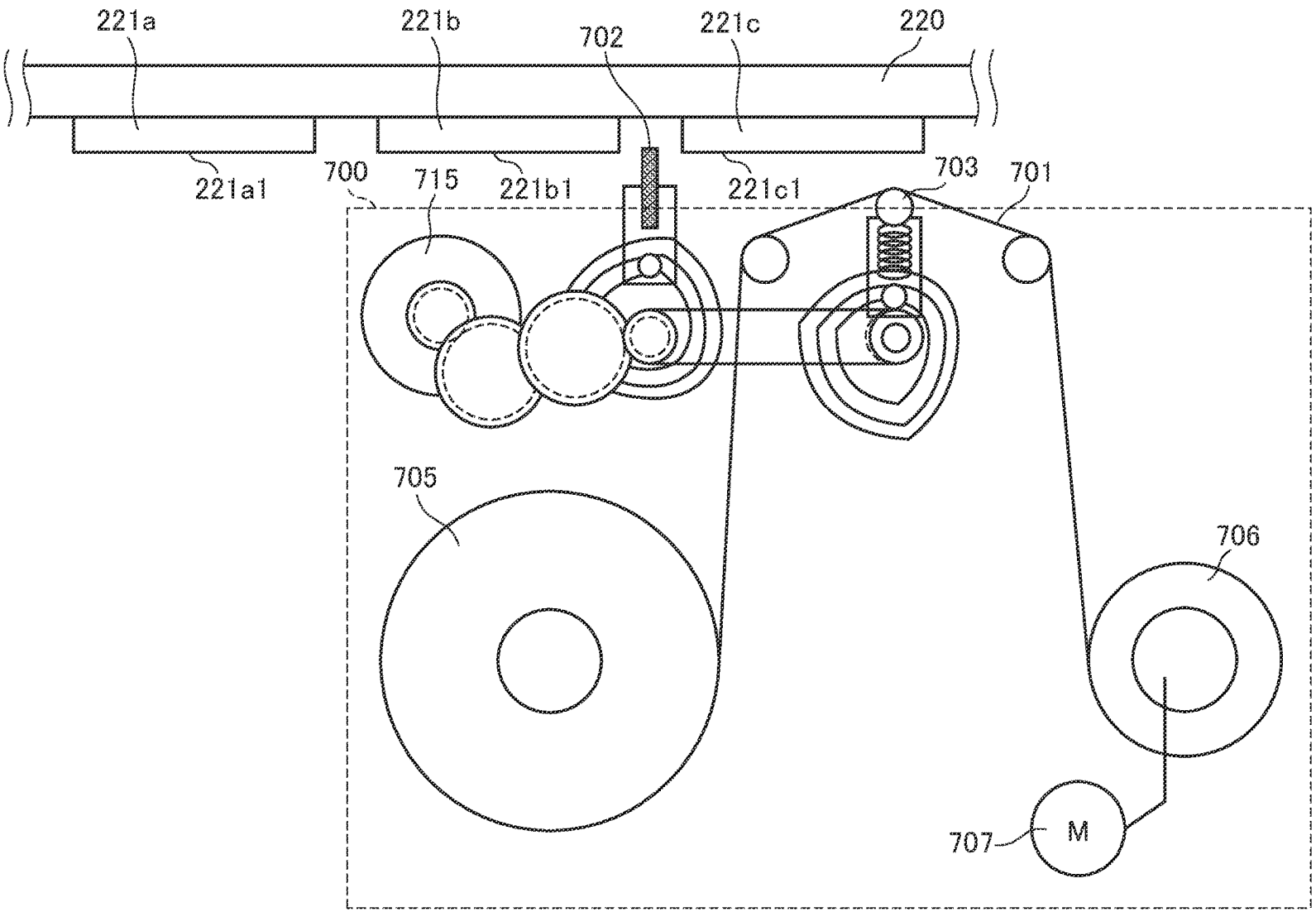
FIG. 18 is an explanatory operation view immediately after the wiper wipes the nozzle face of the liquid discharge head in the second embodiment.

After the wiper 702 moves to the end portion of the nozzle face 221*b*1 of the second liquid discharge head 221*b* and then the wiping is completed with the wiper 702 (step S15: Y), as illustrated in FIG. 18, the wiper 702 is positioned between the second liquid discharge head 221*b* and the third liquid discharge head 221*c*. After this state, the ink discharger 220 ascends (arrow A2 direction) and move to the retraction position spaced apart from the pressing member 703 by the predetermined distance (step S16), so that the cleaning of the nozzle face 221*b*1 of the second liquid discharge head 221*b* finishes.

Operation similar to the operation to the second liquid discharge head 221*b*, is repeated for the first liquid discharge head 221*a* and the third to eighth liquid discharge heads 221*c* to 221*h*, to perform cleaning to the ink discharger 220.

Figure 19:
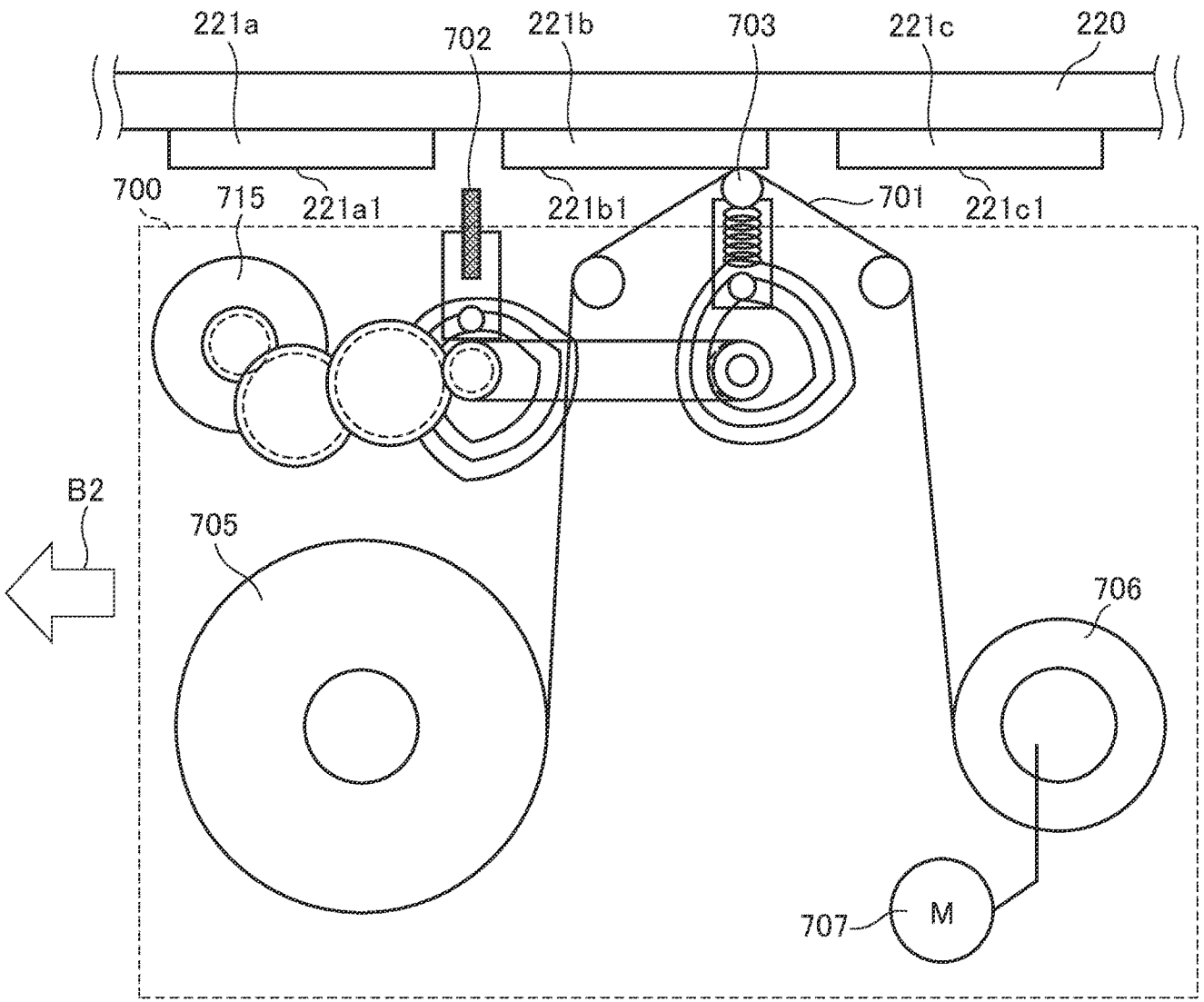
FIG. 19 is an explanatory operation view of the web wiping the nozzle face of the liquid discharge head while the web is moving in one direction, in the second embodiment.
Figure 20:
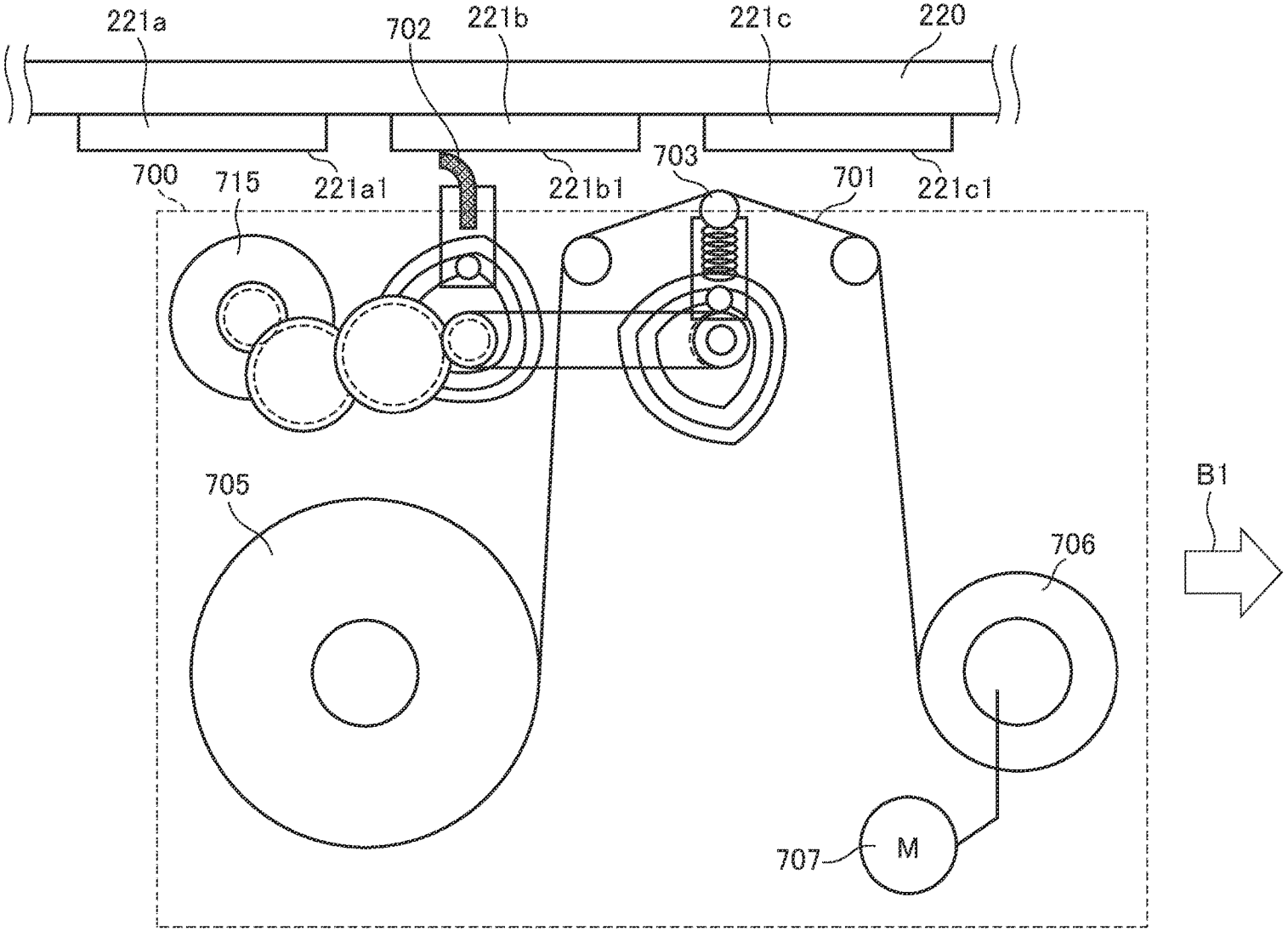
FIG. 20 is an explanatory operation view of the wiper wiping the nozzle face of the liquid discharge head while the wiper is moving in the other direction, in the second embodiment.

As illustrated in FIGS. 19 and 20, the wiping directions of the web 701 and the wiper 702 may be different from each other. In FIG. 19, the wiping direction of the web 701 to the nozzle face 221*b*1 of the second liquid discharge head 221*b* is in the arrow B2 direction. In FIG. 20, the wiping direction of the wiper 702 to the nozzle face 221*b*1 of the second liquid discharge head 221*b* is in the arrow B1 direction. That is, depending on the positional relationship between the pressing member 703 and the wiper 702 or the positional relationship between the liquid discharge heads 221, there is a possibility that wiping in different directions as indicated with the arrow B1 direction and the arrow B2 direction can shorten operating time. Unidirectionally wiping or multidirectionally wiping may be appropriately selected in consideration of operating time depending on layout circumstances.

Note that the wiping operation to the nozzle face 221*b*1 of the second liquid discharge head 221*b* has been described above. The nozzle face 221*a*1 of the first liquid discharge head 221*a* and the nozzle faces 221*c*1 to 221*h*1 of the third to eighth liquid discharge heads 221*c* to 221*h*, are wiped with similar operation. Cleaning of the nozzle faces 221*a*1 to 221*h*1 is performed in this manner.

The other constituent elements that have not been described specifically are similar in configuration to the constituent elements according to the first embodiment, and function similarly to the constituent elements according to the first embodiment.

According to the present embodiment, driving the wiping switching motor 715 as the drive source causes the wiper holder 718 and the pressing-member holder 716 to driven in synchronization with each other. Accordingly, the linear motion of the first wiping member 701 and the linear motion of the second wiping member 702 can be synchronously executed with a simple configuration.

Third Embodiment

Figure 21:
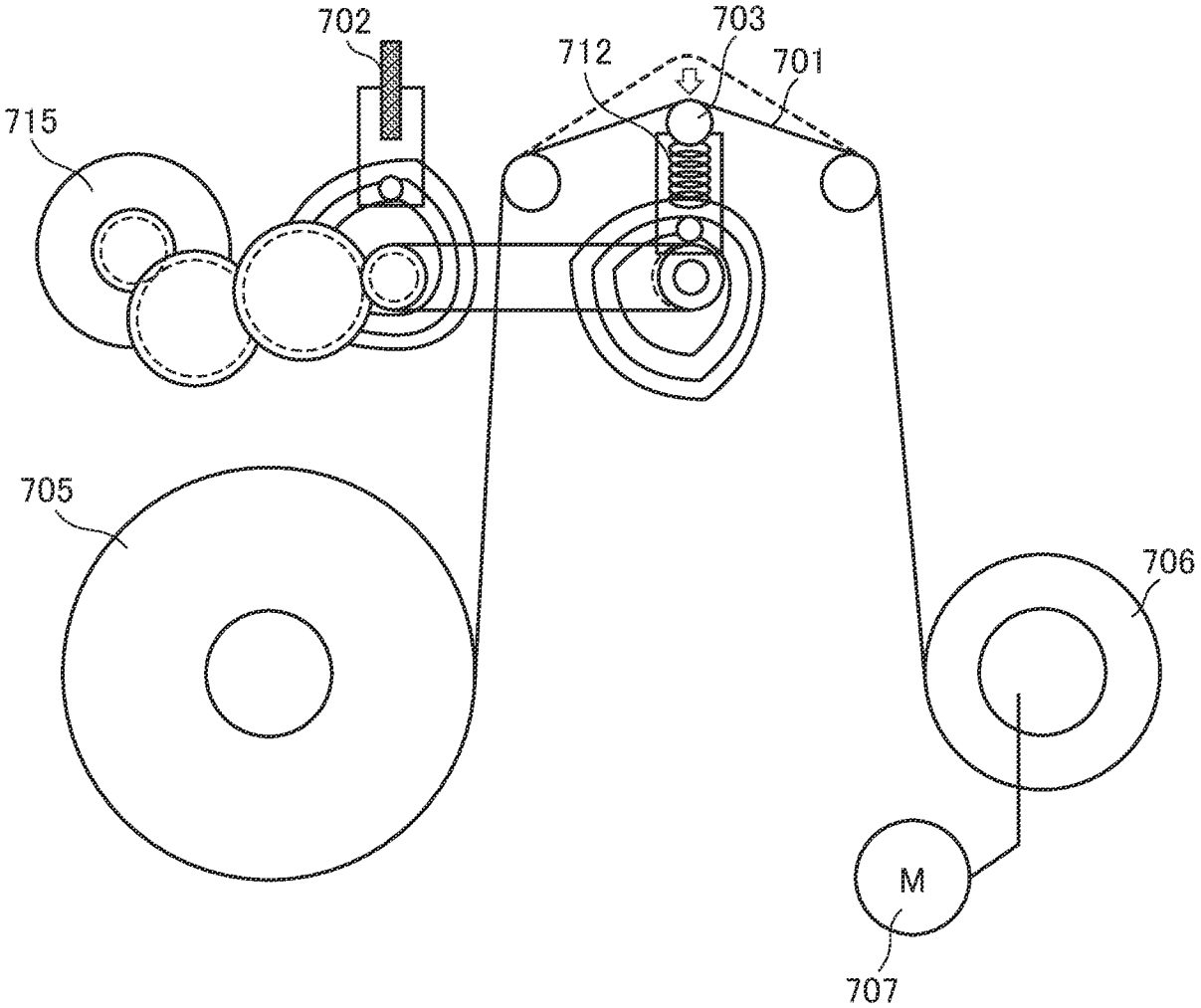
FIG. 21 is an explanatory view of the movement operation of a web when a pressing member moves from a wiping position to a retraction position in a third embodiment.

In the second embodiment, in a case where the pressing member 703 is at the wiping position, the web 701 has been energized upward by a compression spring 712 disposed at the lower portion of the pressing member 703. When the pressing member 703 moves from the wiping position to the retraction position, as indicated with a solid line in the explanatory view of FIG. 21 illustrating the movement operation of the web 701, the web 701 moves downward from the dotted-line position to the retraction position due to its own weight. At this time, there is a possibility that, regardless of the movement of the pressing member 703 to the retraction position, the web 701 stays at the wiping position indicated with the dotted line in the figure and does not move downward.

Figure 22:
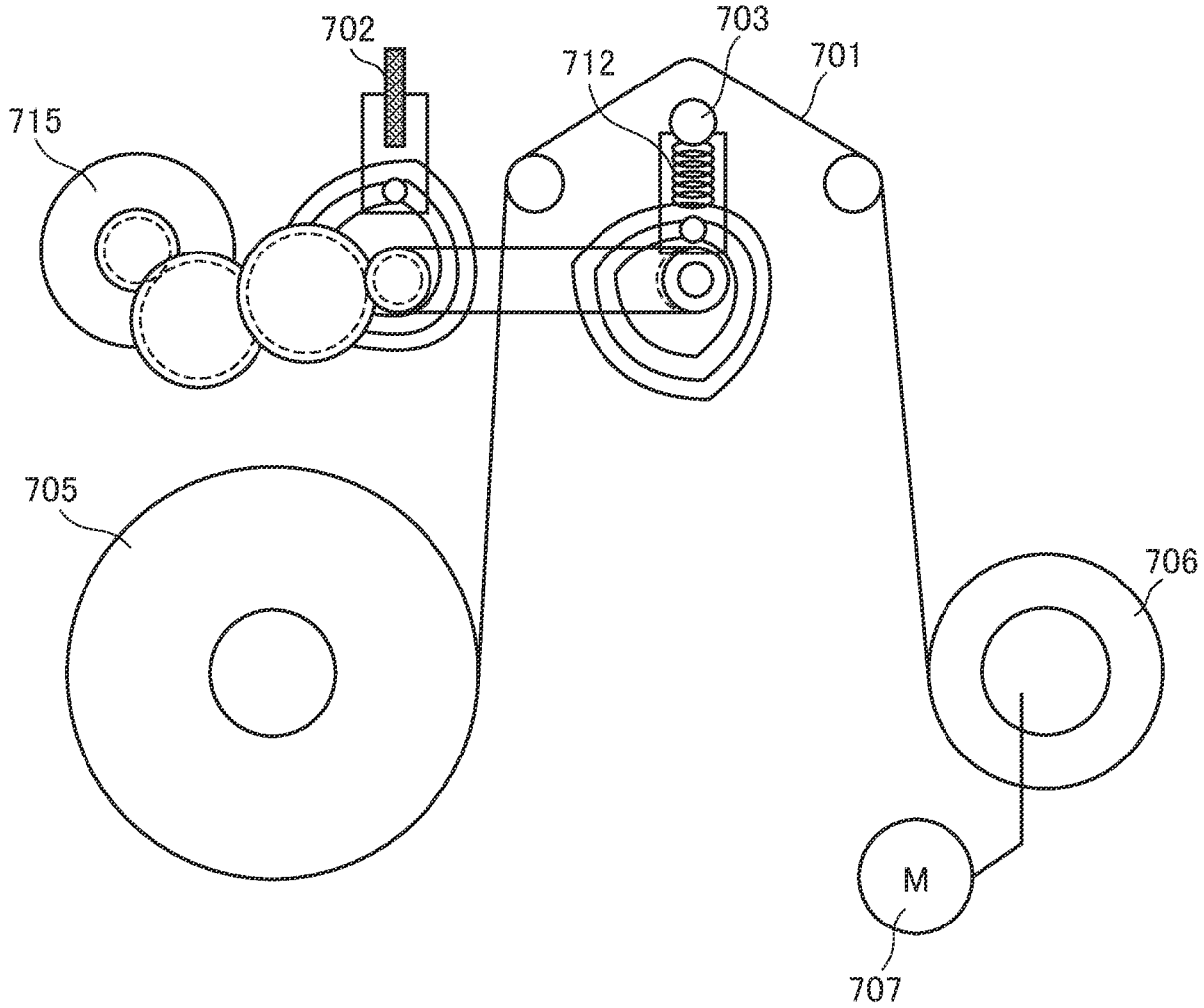
FIG. 22 is an explanatory view of the web staying at the wiping position from the state of FIG. 21.

For example, when ink adhering to the web 701 dries after the web 701 wipes the nozzle face 221-1, as can be understood from the explanatory view of FIG. 22 illustrating that the web 701 stays at the wiping position, there is a possibility that solidification of the web 701 causes the web 701 to stay in the shape in which the pressing member 703 is at the wiping position. This state causes the web 701 to come in contact with a liquid discharge head 221 not to be wiped even when the pressing member 703 is at the retraction position, resulting in a stain on the nozzle face 221-1 or a fault in discharging.

In order to solve the problem, use of a configuration in which the web 701 is sandwiched from above and below by the pressing member 703, enables the web 701 to follow the pressing member 703 along with movement of the pressing member 703. However, the web 701 performs wiping while being pressed against the nozzle face 221-1. Thus, disposition of a component on the upper side of the web 701 causes the component to come in contact with the nozzle face 221-1, resulting in damage of the nozzle face 221-1. Therefore, the configuration in which the web 701 is sandwiched from above and below by the pressing member 703, cannot be adopted.

Figure 23:
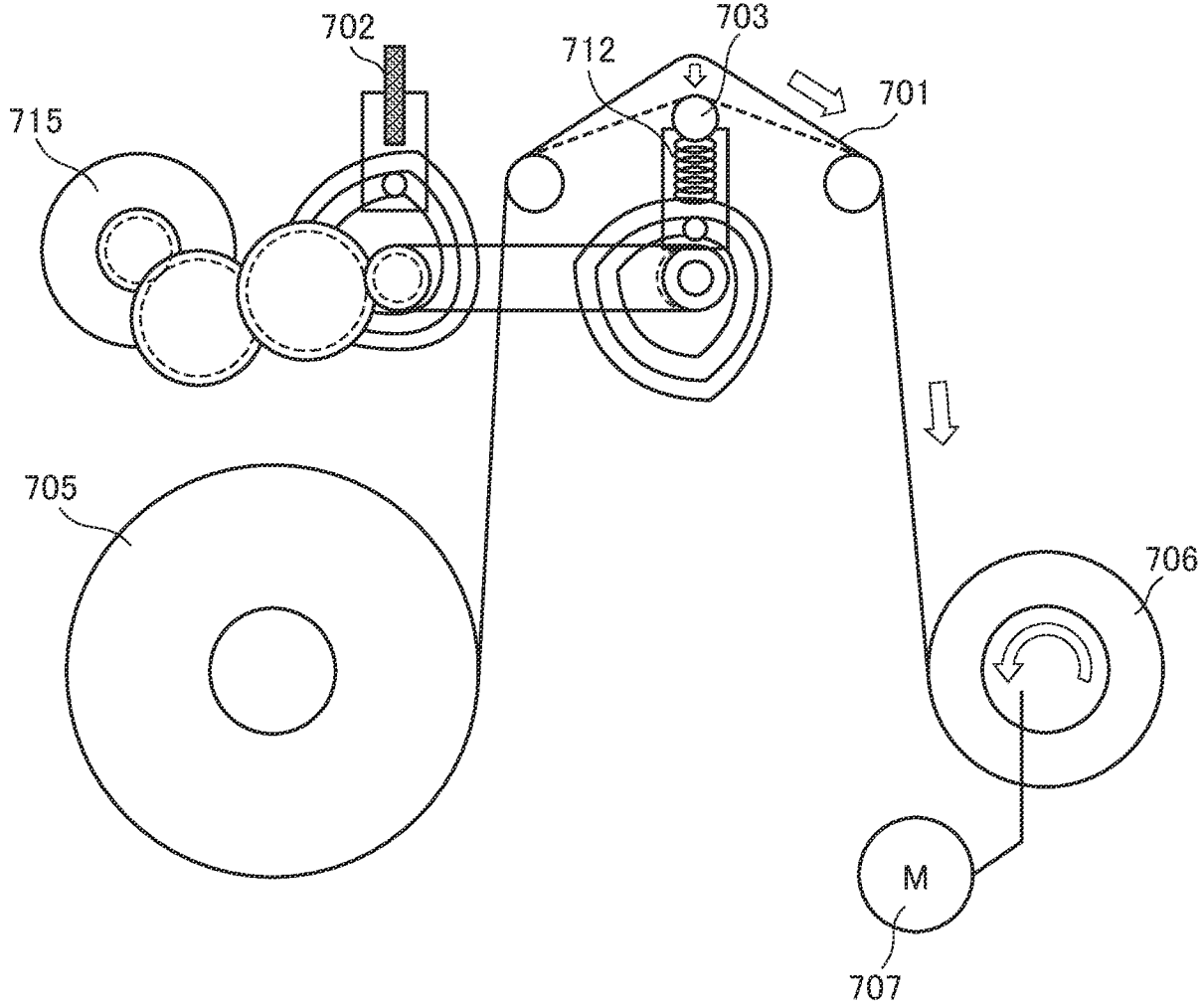
FIG. 23 is an explanatory view of an operation of reeling in the web from the state of FIG. 21 to move the web to the retraction position, reliably.

Thus, according to a third embodiment, a web 701 retracts reliably along with retraction operation of a pressing member 703. FIG. 23 is an explanatory operation view of an operation of retracting the web 701 more reliably so that the web 701 does not come in contact with a liquid discharge head 221, in the third embodiment.

According to the present embodiment, as illustrated in FIG. 23, after movement of the pressing member 703 to a retraction position, a CPU 510 operates a reeling motor 707 to perform reeling by the amount of slack of the web 701 caused by the movement of the pressing member 703. This arrangement enables the web 701 to descend reliably to the retraction position of the pressing member 703. The timing at which the reeling motor 707 performs reeling on the web 701, is not necessarily after movement of the pressing member 703 to the retraction position, and thus may be the same as the timing at which the pressing member 703 starts to move to the retraction position.

Conversely, when the pressing member 703 moves from the retraction position to a wiping position, the CPU 510 rotates the reeling motor 707 reversely and makes slack to the web 701 to move the pressing member 703 to the wiping position. This arrangement enables a reduction in load when the pressing member 703 moves from the retraction position to the wiping position, so that the pressing member 703 can move reliably to the wiping position.

The other constituent elements that have not been described specifically are similar in configuration to the constituent elements according to the first and second embodiments, and function similarly to the constituent elements according to the first and second embodiments.

Figure 25:
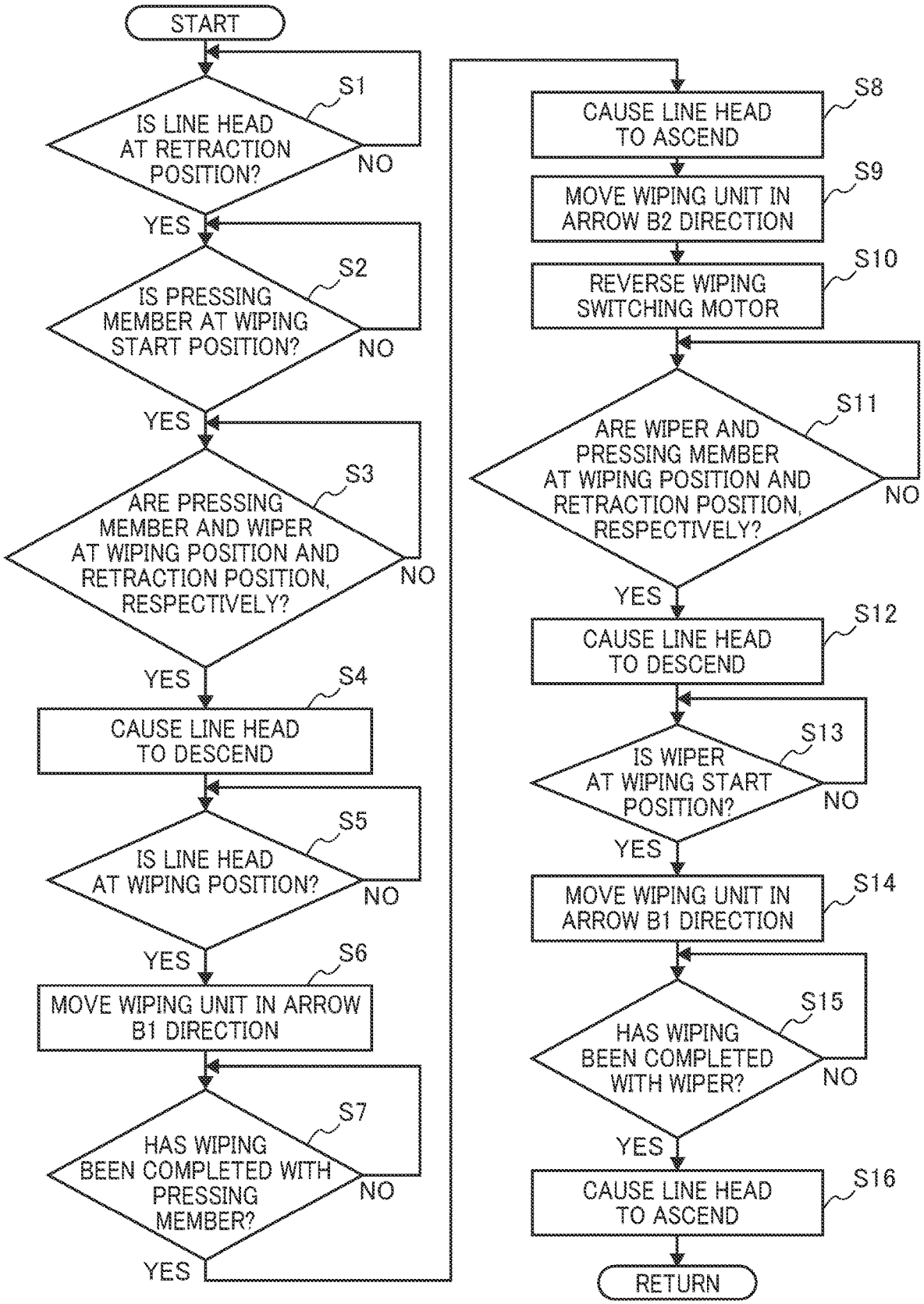
FIG. 25 is a flowchart of an operation procedure of wiping operation according to the second embodiment.

Note that, in the first to third embodiments, control circuitry 500 included in an image forming device 200 performs the control of each constituent element. FIG. 25 is a block diagram of the main of the control circuitry 500. The control circuitry 500 controls, for example, the driving of a wiping switching motor 715, the liquid discharging of liquid discharge heads 221, the proximity and separation operation of the liquid discharge heads 221 to wiping units 700, the movement of the wiping units 700 along the nozzle faces 221-1 of the liquid discharge heads 221.

The control circuitry 500 includes: a control subject including a CPU 510, a read only memory (ROM) 520, and a random access memory (RAM) 530; control objects to be controlled; and a communication interface. The constituent elements are electrically mutually connected through a bus line, such as an address bus or a data bus.

In the present embodiment, the control objects include a wiping switching motor 715, a reeling motor 707, a line-head elevation motor 551, a wiping-unit movement motor 552, and a liquid-discharge-head drive unit 553. The control objects are controlled through first to fourth motor controllers 541, 542, 543, and 544, and a head controller 545. The line-head elevation motor 551 is a motor that drives a line-head elevation drive assembly that moves the ink discharger 220 indicated with the arrows A1 and A2 in the figures to the wiping position and the retraction position. The wiping-unit movement motor 552 is a motor that drives a wiping-unit drive assembly that moves the wiping unit 700 indicated with the arrows B1 and B2 in the figures parallel in the arrangement direction of the liquid discharge heads 221 of the ink discharger 220. The head controller 545 is used to control head energization and liquid discharging in the liquid-discharge-head drive unit 553.

The CPU 510 executes a computer readable program stored in the ROM 520, to control a sheet feeder 100, an image forming device 200, a dryer 300, and a sheet ejector 400. The ROM 520 stores data or the program to be executed by the CPU 510. The RAM 530 stores the data temporarily when the CPU 510 executes the program.

Correspondence of the present disclosure to each embodiment allows achievement of the following effects. Note that, in the following descriptions, the constituent elements in each embodiment correspond to the constituent elements in the scope of the claims. For different terms between the two, the terms in the latter are indicated with brackets, and the corresponding reference signs are given, so that the correspondence relationship between the two is clarified.

(1) The head cleaning device (wiping unit 700) according to the first or second embodiment includes: a web 701 (first wiping member) that wipes a nozzle face 221-1 of each of a plurality of liquid discharge heads 221; the second gear drive train 708, the timing belt 713, and the pressing-member elevation cam 714 (first drive mechanism) that move the web 701 to the wiping position at which the web 701 wipes the nozzle face 221-1 or the retraction position spaced apart from the nozzle face 221-1; the wiper 702 (second wiping member) that wipes the nozzle face 221-1; the second gear drive train 708, the wiper rotation shaft **708*d* or the wiper elevation cam 717 (second drive mechanism) that move the wiper 702 to the wiping position at which the wiper 702 wipes the nozzle face 221-1 or the retraction position spaced apart from the nozzle face 221-1; the wiping switching motor 715 (common drive source) that drives the first drive mechanism and the second drive mechanism; and the CPU 510 (controller) that controls the wiping switching motor 715 (common drive source). Thus, control of the driving of the wiping switching motor 715 (common drive source) enables individual movement of each of the web 701 and the wiper 702 to the wiping position or the retraction position. That is, according to the first or second embodiment, one drive source is provided for the respective operations of two types of wiping mechanisms that wipe the nozzle face 221-1, so that a reduction in costs and miniaturization of an apparatus can be achieved. Because the nozzle face 221-1 is wiped and cleaned with the two different types of wiping mechanisms, cleaning effect on the nozzle face 221-1** can improve.

(2) According to the first or second embodiment, the web 701 is a sheet-shaped wiping member to wipe the nozzle face 221-1 for cleaning. Such a configuration can enhance the effect of cleaning the nozzle face 221-1.

(3) According to the first or second embodiment, the wiping unit 700 (head cleaning device) includes the timing belt 713 (drive-force transmitter) that transmits drive force of the second gear drive train 708 (second drive mechanism) that drives the wiper 702 (second wiping member), to the pressing-member elevation cam 714 (first drive mechanism) that drives the web 701 (first wiping member). The movement of the web 701 (first wiping member) and the movement of the wiper 702 (second wiping member) are performed in synchronization by the wiping switching motor 715 (drive source). Thus, the two can be controlled constantly at the same timing, and the nozzle face 221-1 can be wiped reliably with a simple control configuration.

(4) According to the first embodiment, the wiping unit 700 (head cleaning device) includes the wiper rotation shaft **708*d* (first rotary body) to be rotated by the wiping switching motor 715, the pressing-member elevation cam 714 (first eccentric cam) coupled with the wiper rotation shaft 708*d* so that a drive force is transmitted from the wiper rotation shaft 708*d* to the pressing-member elevation cam 714, and the pressing-member holder 716 (first holder) including a contact portion 716*d* to contact the pressing-member elevation cam 714 and being linearly movable with rotation of the pressing-member elevation cam 714. The wiper rotation shaft 708*d* holds the wiper 702 (second wiping member) so that the wiper 702 is rotatable. The pressing-member holder 716 holds the web 701 so that the web 701 is linearly movable. Thus, the wiper rotation shaft 708*d* and the pressing-member holder 716 are driven in synchronization with each other by driving of the wiping switching motor 715 as the driving source. Accordingly, the linear motion of the first wiping member (the web 701) and the rotational motion of the second wiping member (the wiper 702**) can be synchronously performed with a simple configuration.

(5) According to the second embodiment, the wiping unit 700 (head cleaning device) includes the wiper elevation cam 717 (second eccentric cam), the pressing-member elevation cam 714 (first eccentric cam) coupled with the wiper elevation cam 717 so that a drive force is transmitted from the wiper elevation cam 717 to the pressing-member elevation cam 714, the wiper holder 718 including the second protrusion **718*a* (second contact portion) to contact the wiper elevation cam 717 and being linearly movable with rotation of the wiper elevation cam 717, and the pressing-member holder 716 (first holder) including the first protrusion 716*a* (first contact portion) to contact the pressing-member elevation cam 714 and being linearly movable with rotation of the wiper elevation cam 717. The wiper holder 718 (second holder) holds the wiper 702 (second wiping member) so that the wiper 702 is linearly movable. The pressing-member holder 716 holds the web 701 (first wiping member) so that the web 701 is linearly movable. Thus, the wiper holder 718 and the pressing-member holder 716 are driven in synchronization with each other by driving of the wiping switching motor 715. Accordingly, the linear motion of the web 701 and the linear motion of the wiper 702** can be synchronously performed with a simple configuration.

(6) According to the first or second embodiment, the second gear drive train 708, the timing belt 713, and the pressing-member elevation cam 714 (first drive mechanism) move the web 701 (first wiping member) by a linear motion of the pressing-member holder 716 due to the pressing-member elevation cam 714, and the second gear drive train 708, the wiper rotation shaft **708*d*, or the wiper elevation cam 717 (second drive mechanism) move the wiper 702 (second wiping member) by a circular motion or a linear motion. Thus, the web 701 (first wiping member) and the wiper 702 (second wiping member) can be each moved to the wiping position or the retraction position by the single wiping switching motor 715 (single drive source). In that case, depending on an object to be wiped, movement by the circular motion or movement by the linear motion can be appropriately set for the wiper 702** (second wiping member).

(7) According to the second embodiment, the linear motions in (6) are each performed vertically to the nozzle face 221-1 by the pressing-member elevation cam 714 or the wiper elevation cam 717 (cam assembly). Thus, movement can be performed between the wiping position and the retraction position even in a narrow space, resulting in contribution to miniaturization of an apparatus.

(8) According to the second embodiment, the movement of the web 701 (first wiping member) and the movement of the wiper 702 (second wiping member) are performed by normal rotation or reverse rotation of the wiping switching motor 715 (drive source). Thus, control of the drive direction of the wiping switching motor 715 enables the movement of the web 701 and the movement of the wiper 702. Speed can be changed between the normal rotation and the reverse rotation, so that variation can be expanded in control.

(9) According to the second embodiment, the wiping switching motor 715 (drive source) changes in speed between the normal rotation and the reverse rotation. Thus, control corresponding to the loads of the first drive mechanism and the second drive mechanism, can be performed. For example, slowing the rotation higher in load causes the burden of motor torque to decrease, so that an inexpensive motor can be selected.

(10) According to the first or second embodiment, a first wiping operation of wiping the nozzle face 221-1 with either the web 701 (first wiping member) or the wiper 702 (second wiping member) is performed, and a second wiping operation of wiping the nozzle face 221-1 with another wiping member after the first wiping operation is performed. Thus, wiping is performed twice to the same nozzle face 221-1. This arrangement enables improvement in wiping efficiency.

(11) According to the second embodiment, in (10), the first wiping operation and the second wiping operation are different in wiping direction. Thus, one round trip enables wiping twice, so that wiping time can shorten.

(12) According to the first or second embodiment, the web 701 that is the first wiping member has absorbency, and the wiper 702 (blade) that is the second wiping member has no absorbency. Thus, different wiping effects can be acquired with wiping members having different properties.

(13) According to the third embodiment, the wiping unit 700 (head cleaning device) includes a pressing member 703 that moves a web 701 (first wiping member) to a wiping position to press the web 701 against a nozzle face 221-1; and a reeling roll 706 and a reeling motor 707 that move the web 701 (first wiping member) along the pressing member 703. Simultaneously with or immediately after the pressing member 703 completes movement of the web 701 from the wiping position to the retraction position, the reeling motor 707 and the reeling roll 706 (conveying member) reels in the web 701 (first wiping member) to start conveyance of the web 701. Thus, the web 701 can be reliably retracted.

(14) According to the third embodiment, in (13), the reeling motor 707 and the reeling roll 706 (conveying member) reel back the web 701 to make slack to the web 701, before the pressing member 703 comes in contact with the web 701 (first wiping member) during movement of the pressing member 703 from the retraction position to the wiping position. Thus, the pressing member 703 can move reliably to the wiping position.

(15) An image forming device 200 (liquid discharge apparatus) includes the head cleaning device described in any of (1) to (14). Thus, an image forming device having the effect described in any of (1) to (14) and furthermore an image forming system including the image forming device, can be provided.

Note that embodiments of the present disclosure are not limited to the embodiments described above. Various modifications can be made without departing from the scope of the gist of the present disclosure. The present disclosure includes all technical matters included in the technical idea described in the scope of the claims. The embodiments are preferred exemplifications. A person skilled in the art can implement various alternatives, alternations, modifications, or improvements from the contents disclosed in the present specification, and these are to be included in the technical scope described in the scope of the accompanying claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A head cleaning device comprising:

a first wiping member to wipe a nozzle face of each of a plurality of liquid discharge heads;

a first drive mechanism to move the first wiping member to a first wiping position at which the first wiping member wipes the nozzle face and a first retraction position spaced apart from the nozzle face;

a second wiping member to wipe the nozzle face;

a second drive mechanism to move the second wiping member to a second wiping position at which the second wiping member wipes the nozzle face and a second retraction position spaced apart from the nozzle face;

a common drive source to drive the first drive mechanism and the second drive mechanism;

control circuitry to control the common drive source; and a driving-force transmitter to transmit drive force of the second drive mechanism to the first drive mechanism, wherein the first wiping member and the second wiping member are moved in synchronization with each other by the common drive source through the driving-force transmitter.

2. The head cleaning device according to claim 1, wherein the first wiping member is a sheet-shaped member.

3. The head cleaning device according to claim 1, wherein the first wiping member includes an absorbent web, and wherein the second wiping member includes an unabsorbent blade.

4. The head cleaning device according to claim 1, further comprising:

a rotary body to be rotated by the common drive source;

an eccentric cam coupled with the rotary body so that drive force is transmitted from the rotary body to the eccentric cam; and a holder including a contact portion and being linearly movable with rotation of the eccentric cam, wherein the rotary body holds the second wiping member so that the second wiping member is rotatable, and wherein the holder holds the first wiping member so that the first wiping member is linearly movable.

5. The head cleaning device according to claim 1, further comprising:

a first eccentric cam;

a second eccentric cam to be rotated by the common drive source, the second eccentric cam coupled with the first eccentric cam so that drive force is transmitted from the second eccentric cam to the first eccentric cam;

a first holder including a first contact portion to contact the first eccentric cam and being linearly movable with rotation of the second eccentric cam; and a second holder including a second contact portion to contact the second eccentric cam and being linearly movable with the rotation of the second eccentric cam, wherein the second holder holds the second wiping member so that the second wiping member is linearly movable, and wherein the first holder holds the first wiping member so that the first wiping member is linearly movable.

6. The head cleaning device according to claim 1, wherein the first drive mechanism moves the first wiping member by a linear motion, and wherein the second drive mechanism moves the second wiping member by a circular motion or a linear motion.

7. The head cleaning device according to claim 6, further comprising a cam assembly performs the linear motion in a vertical direction to the nozzle face.

8. The head cleaning device according to claim 1, wherein the first wiping member and the second wiping member are moved by normal rotation or reverse rotation of the common drive source.

9. The head cleaning device according to claim 8, wherein the control circuitry changes speed of the common drive source between the normal rotation and the reverse rotation.

10. The head cleaning device according to claim 1, wherein the control circuitry performs a first wiping operation of wiping the nozzle face with one of the first wiping member and the second wiping member and a second wiping operation of wiping the nozzle face with another wiping member of the first wiping member and the second wiping member after the first wiping operation.

11. The head cleaning device according to claim 10, wherein a wiping direction of the first wiping operation is different from a wiping direction of the second wiping operation.

12. The head cleaning device according to claim 1, further comprising:

a pressing member to move the first wiping member to the first wiping position to press the first wiping member against the nozzle face; and a conveying member to move the first wiping member along the pressing member, wherein, simultaneously with or immediately after the pressing member completes movement of the first wiping member from the first wiping position to the first retraction position, the control circuitry reels in the first wiping member by the conveying member to start conveyance.

13. The head cleaning device according to claim 12, wherein the conveying member reels back the first wiping member to make slack to the first wiping member, before the pressing member contacts the first wiping member when the pressing member moves the first wiping member from the first retraction position to the first wiping position.

14. A liquid discharge apparatus comprising the head cleaning device according to claim 1.

* * * * *